US009855751B2

(12) United States Patent
Sakai et al.

(10) Patent No.: US 9,855,751 B2
(45) Date of Patent: Jan. 2, 2018

(54) METHOD FOR MANUFACTURING LIQUID EJECTING HEAD

(71) Applicant: SEIKO EPSON CORPORATION, Tokyo (JP)

(72) Inventors: Masayuki Sakai, Matsumoto (JP); Yasuo Inaoka, Shiojiri (JP); Minoru Yajima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 635 days.

(21) Appl. No.: 14/457,719

(22) Filed: Aug. 12, 2014

(65) Prior Publication Data

US 2015/0052752 A1 Feb. 26, 2015

(30) Foreign Application Priority Data

Aug. 20, 2013 (JP) ..... 2013-170803

(51) Int. Cl.
*B41J 2/16* (2006.01)
*B41J 2/14* (2006.01)

(52) U.S. Cl.
CPC ..... *B41J 2/1623* (2013.01); *B41J 2/161* (2013.01); *B41J 2002/14362* (2013.01); *B41J 2002/14491* (2013.01); *B41J 2202/19* (2013.01); *Y10T 29/49401* (2015.01)

(58) Field of Classification Search
CPC . B41J 2/14; B41J 2/1621; B41J 2/1607; B41J 2/1623; B41J 2/161
USPC ... 29/890.1, 890.09, 25.35, 529.1, 739, 729, 29/832; 347/20, 54, 56–58, 68
See application file for complete search history.

(56) References Cited

U.S. PATENT DOCUMENTS 6,168,254 B1 * 1/2001 Karita ..... B41J 2/14024 347/20
8,523,326 B2 * 9/2013 Enomoto ..... B41J 2/14233 347/50
8,826,524 B2 * 9/2014 Matsuoka ..... B41J 2/16508 29/759
9,022,528 B2 * 5/2015 Watanabe ..... B41J 2/14201 347/50
2006/0066689 A1 * 3/2006 Hori ..... B41J 2/14233 347/68

(Continued)

FOREIGN PATENT DOCUMENTS

JP 2010-115918 5/2010

*Primary Examiner* — Peter DungBa Vo
*Assistant Examiner* — Kaying Kue
(74) *Attorney, Agent, or Firm* — Workman Nydegger

(57) ABSTRACT

Provided is a method for manufacturing a recording head having a head chip that ejects ink, an upstream flow path member, a downstream flow path member where an accommodating portion and a downstream flow path are disposed, a wiring member that is connected to a piezoelectric actuator in the head chip, a wiring substrate, a first insertion hole into which the wiring member and a tool are inserted, and a second insertion hole where a wiring member insertion portion into which the wiring member is inserted and a tool insertion portion into which the tool can be inserted are integrally formed, the method including inserting the tool into the tool insertion portion, holding the wiring member with the tool, withdrawing the tool from the tool insertion portion by moving the downstream flow path member to the head chip side, and inserting the wiring member into the wiring member insertion portion.

4 Claims, 15 Drawing Sheets

(56) References Cited

U.S. PATENT DOCUMENTS

| | | | | |
|---|---|---|---|---|
| 2009/0025200 | A1* | 1/2009 | Matsuoka | B41J 2/16508 29/559 |
| 2009/0201346 | A1* | 8/2009 | Miyata | B41J 2/055 347/71 |
| 2010/0091071 | A1* | 4/2010 | Owaki | B41J 2/17523 347/50 |

* cited by examiner

METHOD FOR MANUFACTURING LIQUID EJECTING HEAD

CROSS-REFERENCE TO RELATED APPLICATIONS

The present application claims priority to Japanese Patent Application No. 2013-170803 filed on Aug. 20, 2013, which is hereby incorporated by reference in its entirety.

BACKGROUND

1. Technical Field

The present invention relates to a method for manufacturing a liquid ejecting head that ejects a liquid from a nozzle and, more particularly, to a method for manufacturing an ink jet type recording head that discharges ink as a liquid.

2. Related Art

Representative examples of liquid ejecting heads that discharge a liquid include ink jet type recording heads that discharge ink droplets. Proposed as an example of the ink jet type recording heads is an ink jet type recording head including a head chip that has a flow path forming substrate where a pressure generating chamber communicating with a nozzle is formed, and a case member where a wiring substrate that is connected to a pressure generating unit which is disposed in the head chip is held, in which the wiring substrate and the pressure generating unit of the head chip are interconnected via a wiring member such as a COF (for example, refer to JP-A-2010-115918).

An area that is used to route the wiring member which is formed in the case member and the like to the wiring substrate is narrow. In particular, such an area has to be extremely narrow in the ink jet type recording head which is compact in size. However, it is difficult to insert the wiring member having flexibility such as the COF into a narrow opening and route and connect the wiring member to the wiring substrate, which results in an increase in the complexity of an assembly operation.

These disadvantages are not limited to the ink jet type recording head, and are present in a similar manner in liquid ejecting heads ejecting other liquids.

SUMMARY

An advantage of some aspects of the invention is to provide a method for manufacturing a liquid ejecting head by which assembly costs can be reduced.

According to an aspect of the invention, there is provided a method for manufacturing a liquid ejecting head including a head chip that ejects a liquid from a liquid ejecting surface, a first flow path member where a first flow path for the liquid is disposed, a second flow path member that is bonded to the first flow path member, where an accommodating portion that is open to the side opposite to the first flow path member and accommodates the head chip and a second flow path for the liquid that is open into the accommodating portion and is connected to the first flow path are disposed, a wiring member that is connected to a pressure generating unit which generates pressure change in a flow path in the head chip, and a wiring substrate that is arranged between the first flow path member and the second flow path member, in which the wiring member, into which a first insertion hole that is open to the first flow path member and the second flow path member side and is formed in the wiring substrate and a second insertion hole that is open to the accommodating portion and the wiring substrate side and is formed in the second flow path member are inserted, is bonded to the wiring substrate, and the second insertion hole is formed so that a tool which holds the wiring member can be inserted, the method including: inserting the tool from the opening of the second insertion hole on the first flow path member side; holding the wiring member that is connected to the pressure generating unit of the head chip with the tool; and inserting the wiring member into the second insertion hole by relatively moving the tool with respect to the second flow path member so that the tool which holds the wiring member is separated from the second flow path member.

In this aspect, the second insertion hole is formed so that the tool can be inserted. Accordingly, the wiring member can be inserted into the second insertion hole by inserting the tool into the second insertion hole in advance, pinching the wiring member with the tool, and relatively moving the tool with respect to the second flow path member so that the tool is separated from the second flow path member. In other words, the wiring member can be inserted into the second insertion hole with greater ease than when the wiring member is inserted directly into the second insertion hole. In addition, the wiring member can be inserted into the second insertion hole through an operation in the direction intersecting with the liquid ejecting surface alone. In other words, the operation is for a movement in just one direction, and thus an operation for inserting the wiring member into the second insertion hole can be simplified and accelerated. As such, the efforts and time associated with the manufacturing of the liquid ejecting head can be reduced, and the liquid ejecting head can be provided at a low cost.

Herein, it is preferable that the first insertion hole of the wiring substrate be formed so that the tool which holds the wiring member can be inserted, the tool be inserted from the openings of the first insertion hole and the second insertion hole on the first flow path member side, the wiring member that is connected to the pressure generating unit of the head chip be held with the tool, and the wiring member be inserted into the first insertion hole and the second insertion hole by relatively moving the tool with respect to the wiring substrate and the second flow path member so that the tool which holds the wiring member is separated from the wiring substrate and the second flow path member. In this case, since the first insertion hole is formed so that the tool can be inserted, the wiring member can be inserted into the first insertion hole and the second insertion hole by inserting the tool into the first insertion hole in advance, pinching the wiring member with the tool, and relatively moving the tool with respect to the wiring substrate and the second flow path member so that the tool is separated from the wiring substrate and the second flow path member. In other words, the wiring member can be inserted into the first insertion hole and the second insertion hole with greater ease than when the wiring member is inserted directly into the first insertion hole and the second insertion hole. In addition, the wiring member can be inserted into the first insertion hole and the second insertion hole through an operation in the direction intersecting with the liquid ejecting surface alone. In other words, the operation is for a movement in just one direction, and thus an operation for inserting the wiring member into the first insertion hole and the second insertion hole can be simplified and accelerated. As such, the efforts and time associated with the manufacturing of the liquid ejecting head can be reduced, and the liquid ejecting head can be provided at a low cost.

In addition, it is preferable that the head chip be fixed to a fixing member that is fixed to the second flow path member, and the wiring member that is connected to the head chip which is fixed to the fixing member be held by using the tool. In this case, a plurality of the head chips are fixed to the fixing member, and thus the shifting of the head chip and the wiring member that is connected thereto can be suppressed and an operation for inserting the wiring member that is connected to each of the head chips into the second insertion hole can be performed with greater reliability.

In addition, it is preferable that a wiring member insertion portion into which the wiring member is inserted and a tool insertion portion into which the tool is inserted be integrally formed in at least one of the first insertion hole and the second insertion hole, the tool be inserted into the tool insertion portion, and the wiring member be inserted into the wiring member insertion portion by relatively moving the tool with respect to the second flow path member so that the tool which holds the wiring member is separated from the second flow path member. In this case, the wiring member insertion portion can have a size that is required for the wiring member to be inserted, and the tool insertion portion can have a size that is required for the tool to be inserted. As such, the first insertion hole or the second insertion hole can be sufficiently large for the wiring member to be inserted by using the tool, and the liquid ejecting head can be compact in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, embodiments of the invention will be described in detail. An ink jet type recording head is an example of a liquid ejecting head, and is simply referred to as a recording head.

Figure 1:
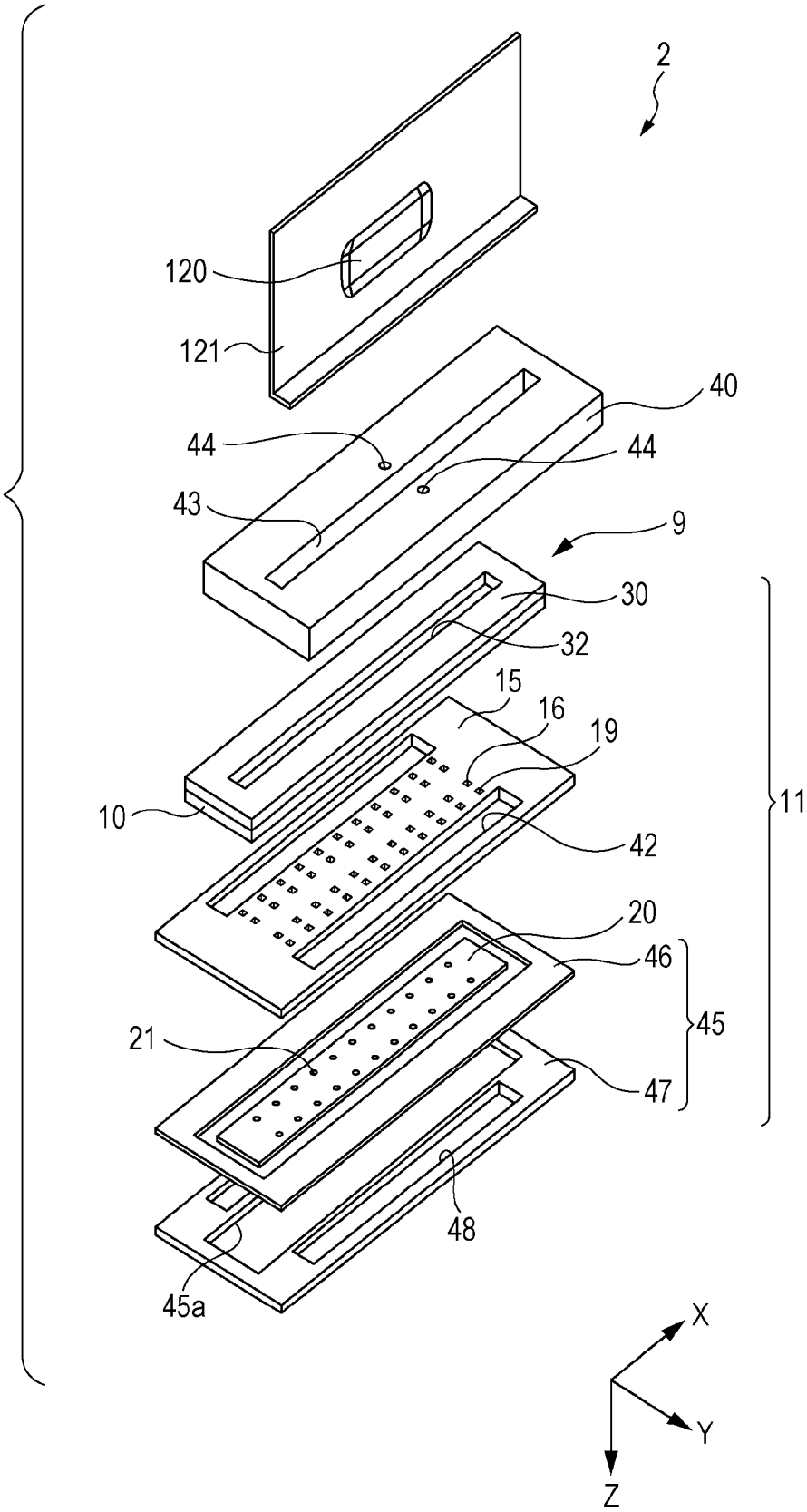
FIG. 1 is an exploded perspective view of a head chip according to a first embodiment.
Figure 2:
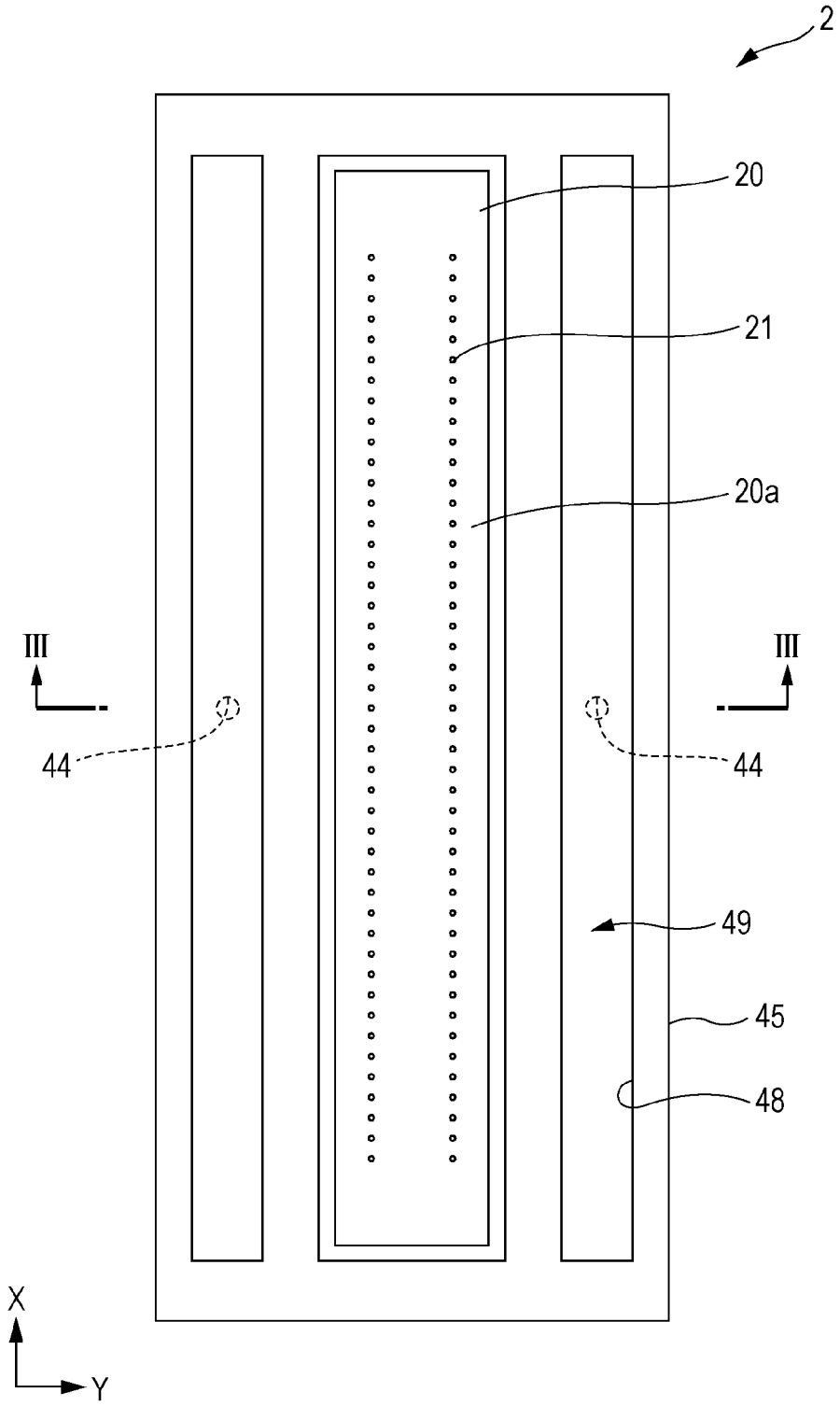
FIG. 2 is a plan view of the head chip according to the first embodiment.
Figure 3:
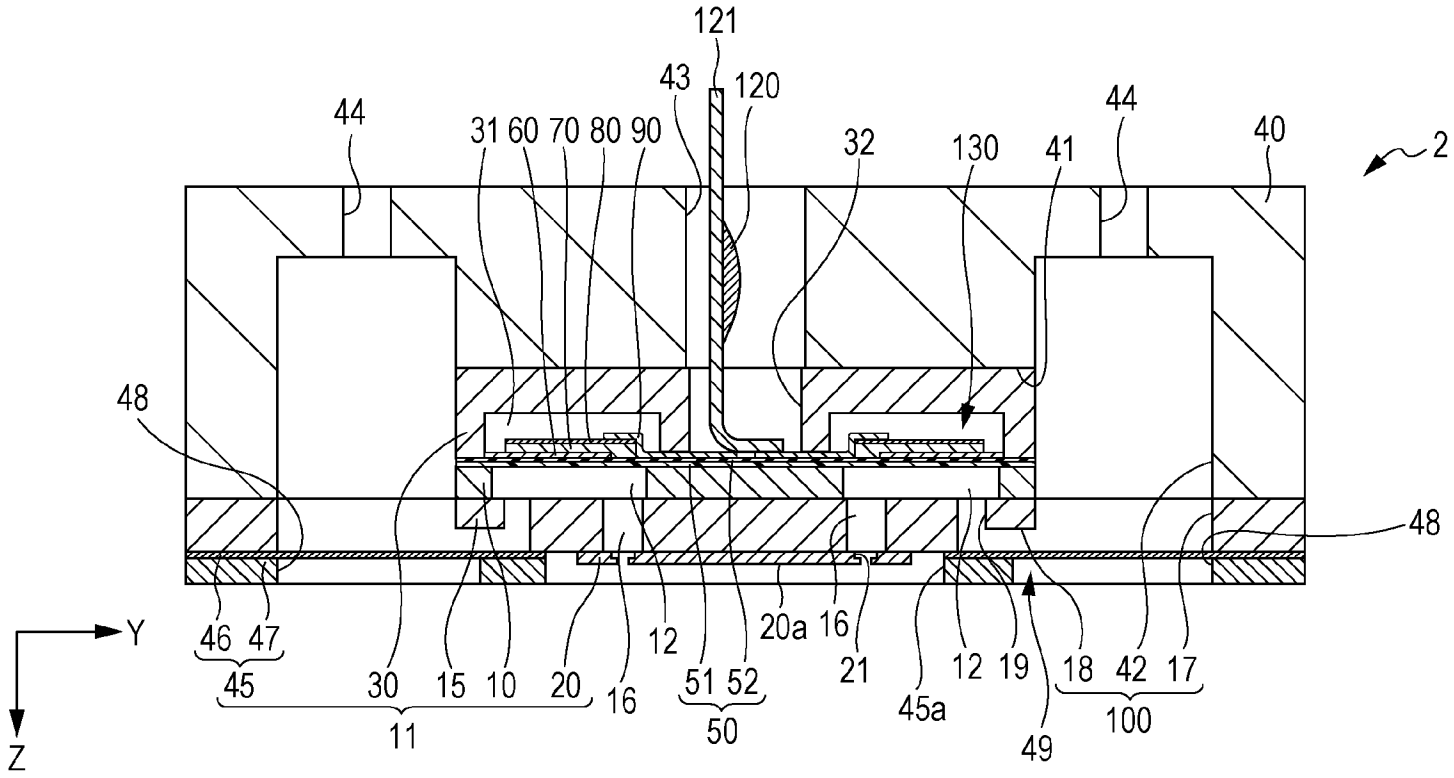
FIG. 3 is a sectional view of the head chip according to the first embodiment.

Firstly, an example of a head chip that is disposed in the recording head according to this embodiment will be described. FIG. 1 is an exploded perspective view of the head chip according to this embodiment. FIG. 2 is a plan view of the head chip. FIG. 3 is a sectional view of the head chip.

As illustrated in the drawings, a head chip 2 includes a plurality of members such as a head main body 11 and a case member 40 that is fixed to the head main body 11 on one surface side. In addition, the head main body 11 has a flow path forming substrate 10, a communicating plate 15 that is disposed on one surface side of the flow path forming substrate 10, a nozzle plate 20 that is disposed on the surface side of the communicating plate 15 opposite to the flow path forming substrate 10, a protective substrate 30 that is disposed on the side of the flow path forming substrate 10 opposite to the communicating plate 15, and a compliance substrate 45 that is disposed on the surface side of the communicating plate 15 where the nozzle plate 20 is disposed.

A metal such as stainless steel and Ni, a ceramic material typified by $ZrO_2$ or $Al_2O_3$, an oxide such as a glass ceramic material, MgO, and $LaAlO_3$, and the like can be used in the flow path forming substrate 10 that constitutes the head main body 11. In this embodiment, the flow path forming substrate 10 is formed of a silicon single crystal substrate. A plurality of pressure generating chambers 12 that are partitioned by a partition wall are juxtaposed on the flow path forming substrate 10, through anisotropic etching from the one surface side, in a direction in which a plurality of nozzles 21 discharging ink are juxtaposed.

Hereinafter, this direction is referred to as a direction of juxtaposition of the pressure generating chambers 12, or a first direction X. In addition, a plurality of rows in which the pressure generating chambers 12 are juxtaposed in the first direction X, two rows in this embodiment, are disposed on the flow path forming substrate 10. Hereinafter, a direction in which the plurality of rows of the pressure generating chambers 12 are disposed is referred to as a second direction Y. Further, a direction that is orthogonal to the first direction X and the second direction Y is referred to as a direction of discharge of ink droplets (liquid droplets) or a third direction Z. The flow path forming substrate 10, the communicating plate 15, and the nozzle plate 20 are stacked in the third direction Z.

In addition, a supply path, which has a smaller opening area than the pressure generating chambers 12 and provides flow path resistance of ink which flows into the pressure generating chambers 12, and the like may be disposed on one end portion sides of the pressure generating chambers 12 in the second direction Y on the flow path forming substrate 10.

In addition, the communicating plate 15 and the nozzle plate 20 are sequentially stacked on the one surface side of the flow path forming substrate 10. In other words, the communicating plate 15 that is disposed on the one surface of the flow path forming substrate 10 and the nozzle plate 20 that is disposed on the surface side of the communicating plate 15 opposite to the flow path forming substrate 10 and has the nozzles 21 are provided.

Nozzle communicating paths 16, which allow the pressure generating chambers 12 and the nozzles 21 to communicate with each other, are disposed in the communicating plate 15. The communicating plate 15 is larger in area than the flow path forming substrate 10, and the nozzle plate 20 is smaller in area than the flow path forming substrate 10. When the communicating plate 15 is disposed in this manner, the nozzles 21 of the nozzle plate 20 and the pressure generating chambers 12 are separated, and thus ink in the pressure generating chambers 12 is unlikely to be affected by thickening caused by the evaporation of moisture in ink occurring in ink in the vicinity of the nozzles 21. In addition, the nozzle plate 20 has only to cover openings of the nozzle communicating paths 16 that allow the pressure generating chambers 12 and the nozzles 21 to communicate with each other, and thus the area of the nozzle plate 20 can be relatively small with reduced costs. In this embodiment, a surface to which ink droplets are discharged with the nozzles 21 of the nozzle plate 20 open is referred to as a liquid ejecting surface 20*a*.

In addition, a first manifold portion 17 and a second manifold portion 18 constituting a part of a manifold 100 are disposed on the communicating plate 15.

The first manifold portion 17 is disposed to penetrate the communicating plate 15 in a thickness direction (stacking direction of the communicating plate 15 and the flow path forming substrate 10 (third direction Z)). The second manifold portion 18 is disposed to be open to the nozzle plate 20 side of the communicating plate 15, without penetrating the communicating plate 15 in the thickness direction.

Furthermore, in the communicating plate 15, supply communicating paths 19 that communicate with the one end portions of the pressure generating chambers 12 in the second direction Y are disposed independently in the respective pressure generating chambers 12. The supply communicating path 19 allows the second manifold portion 18 and the pressure generating chamber 12 to communicate with each other. In other words, in this embodiment, the supply communicating paths 19, the pressure generating chambers 12, and the nozzle communicating paths 16 are disposed as individual flow paths communicating with the nozzles 21 and the second manifold portion 18.

A metal such as stainless steel and nickel (Ni), ceramics such as zirconium (Zr), or the like can be used as the communicating plate 15. It is preferable that the communicating plate 15 employ a material whose linear expansion coefficient is equal to that of the flow path forming substrate 10. In other words, in a case where a material whose linear expansion coefficient is significantly different from that of the flow path forming substrate 10 is used as the communicating plate 15, warpage occurs through heating and cooling due to the difference between the linear expansion coefficient of the flow path forming substrate 10 and the linear expansion coefficient of the communicating plate 15. In this embodiment, the same material, that is, the silicon single crystal substrate is used as the communicating plate 15 as well as in the flow path forming substrate 10 and thus the occurrence of warpage caused by heat, cracks and peeling caused by heat, and the like can be suppressed.

The nozzles 21, which communicate with the pressure generating chambers 12 via the nozzle communicating paths 16, are formed on the nozzle plate 20. Specifically, the nozzles 21 that eject the same type of liquid (ink) are juxtaposed in the first direction X, and two rows of the nozzles 21 juxtaposed in the first direction X are formed in the second direction Y.

The row of the nozzles 21 (nozzle group) is not limited to the nozzle group that is juxtaposed linearly in the first direction X. For example, the nozzle group may be a nozzle group that is configured such that the nozzles 21 juxtaposed in the first direction X are alternately arranged at positions shifted in the second direction Y in a so-called zigzag arrangement. In addition, the nozzle group may be configured such that a plurality of the nozzles 21 juxtaposed in the first direction X are arranged in the second direction Y in a shifted manner. In other words, the nozzle group may be configured by using the plurality of nozzles 21 disposed on the liquid ejecting surface 20*a*, and the arrangement thereof is not particularly limited.

However, in most cases, the direction in which the nozzles 21 are juxtaposed (first direction X) increases in length when the plurality of nozzles 21 (increased number of the nozzles) are arranged in high density. In other words, it is usual that the first direction X is a longitudinal direction and the second direction Y is a short direction in the head chip 2.

A metal such as stainless steel (SUS), an organic material such as a polyimide resin, a silicon single crystal substrate, or the like can be used as the nozzle plate 20. When a silicon single crystal substrate is used as the nozzle plate 20, the occurrence of warpage caused by heating and cooling, cracks and peeling caused by heat, and the like can be suppressed since the linear expansion coefficients of the nozzle plate 20 and the communicating plate 15 are equal to each other.

In addition, the pressure generating chambers 12 are arranged to correspond to the nozzles 21 and pressure generating units, which generate pressure change in ink, are disposed to correspond to the pressure generating chambers 12, and thus the plurality of pressure generating chambers 12 and a plurality of piezoelectric actuators 130, which are the pressure generating units, are juxtaposed in the first direction X. A wiring member 121 (described in detail later), which supplies an electrical signal to the plurality of piezoelectric actuators 130 formed in high density, is connected to the piezoelectric actuators 130 by generating a space in a direction of juxtaposition of the piezoelectric actuators 130 on the substrate, that is, the first direction X (longitudinal direction). Accordingly, the width of the sheet-shaped wiring member 121 is arranged in the direction of juxtaposition of the piezoelectric actuators 130. In other words, when the width direction of the sheet-shaped wiring member 121 is the direction of juxtaposition of the piezoelectric actuators 130, the connection between the piezoelectric actuators 130 and the wiring member 121 can be performed smoothly even if the multiple piezoelectric actuators 130 are arranged in high density.

A vibrating plate 50 is formed on the surface side of the flow path forming substrate 10 opposite to the communicating plate 15. In this embodiment, an elastic membrane 51 formed of silicon oxide, which is disposed on the flow path forming substrate 10 side, and an insulator film 52 formed of zirconium oxide, which is disposed on the elastic membrane 51, are disposed as the vibrating plate 50. A liquid flow path such as the pressure generating chambers 12 is formed through anisotropic etching of the flow path forming substrate 10 from the one surface side (surface side where the nozzle plate 20 is bonded), and the other surface of the liquid flow path such as the pressure generating chambers 12 are defined by the elastic membrane 51.

In addition, a first electrode 60, a piezoelectric layer 70, and a second electrode 80 are formed to be stacked on the insulator film 52 of the vibrating plate 50 and constitute the piezoelectric actuator 130. Herein, the piezoelectric actuator 130 refers to a part that has the first electrode 60, the piezoelectric layer 70, and the second electrode 80. In general, any one of the electrodes of the piezoelectric actuator 130 is a common electrode, and the other electrode and the piezoelectric layer 70 are configured through patterning in each of the pressure generating chambers 12. Herein, a part that is configured by any one of the electrodes that is patterned and the piezoelectric layer 70 and is subjected to piezoelectric distortion caused through voltage application to both of the electrodes is referred to as a piezoelectric active portion. In this embodiment, the first electrode 60 is the common electrode of the piezoelectric actuator 130 and the second electrode 80 is an individual electrode of the piezoelectric actuator 130. However, this may be reversed for the convenience of a drive circuit and wiring. In the example described above, the first electrode 60 is continuously disposed across the plurality of pressure generating chambers 12, and thus the first electrode 60 functions as a part of the vibrating plate. However, for example, only the first electrode 60 may serve as the vibrating plate, without being limited thereto, with the elastic membrane 51 and the insulator film 52 described above not disposed. In addition, the piezoelectric actuator 130 itself may also serve practically as the vibrating plate. However, it is preferable that the first electrode 60 be protected by an insulating protective film or the like, so as to prevent conduction between the first electrode 60 and ink, in a case where the first electrode 60 is disposed directly on the flow path forming substrate 10. In other words, although an example in which the first electrode 60 is configured to be disposed on the substrate (flow path forming substrate 10) via the vibrating plate 50 is described in this embodiment, the first electrode 60 may be disposed directly on the substrate, without being limited thereto, with the vibrating plate 50 not disposed. In other words, the first electrode 60 may serve as the vibrating plate. In other words, to be on the substrate includes a state where another member is interposed (upward) therebetween as well as to be directly on the substrate.

Furthermore, one end portions of lead electrodes 90, which are drawn out of the vicinity of the end portions on the side opposite to the supply communicating paths 19, extend onto the vibrating plate 50, and are formed of gold (Au) or the like, are respectively connected to the second electrodes 80 that are the individual electrodes of the piezoelectric actuators 130. In addition, the wiring member 121 where a drive circuit 120 (described later) is disposed to drive the piezoelectric actuators 130, which are the pressure generating units, is connected to the other end portions of the lead electrodes 90. A flexible sheet-shaped wiring member such as a COF substrate can be used as the wiring member 121. The drive circuit 120 may not be disposed in the wiring member 121. In other words, the wiring member 121 is not limited to the COF substrate, and may include FFC, FPC, and the like.

The other end portions of the lead electrodes 90 connected to the wiring member 121 are disposed to be juxtaposed in the first direction X. It is conceivable to extend the other end portions of the lead electrodes 90 to the one end portion side of the flow path forming substrate 10 in the first direction X and juxtapose the other end portions of the lead electrodes 90 in the second direction Y. However, this results in an increase in the size and costs of the recording head because a space is required for the lead electrodes 90 to be routed. In addition, the width of the lead electrodes 90 decreases and electrical resistance increases when the multiple piezoelectric actuators 130 are disposed in high density to increase the number of the nozzles. Accordingly, the piezoelectric actuators 130 may not be in normal driving with the lead electrodes 90 routed and the electrical resistance further increased. In this embodiment, the other end portion sides of the lead electrodes 90 extend between the two rows of the piezoelectric actuators 130 juxtaposed in the first direction X and the other end portions of the lead electrodes 90 are juxtaposed in the first direction X so that the recording head 1 can be compact in size and lower in cost with no increase in size, an increase in electrical resistance can be suppressed in the lead electrodes 90, and the number of the nozzles can be increased with the multiple piezoelectric actuators 130 disposed in high density.

In addition, in this embodiment, the other end portions of the lead electrodes 90 are disposed between the rows of the piezoelectric actuators 130 in the second direction Y and the lead electrodes 90 and the wiring member 121 are connected with each other between the rows of the piezoelectric actuators 130, and thus the one wiring member 121 is connected to the two rows of the piezoelectric actuators 130 via the lead electrodes 90. The wiring member 121 is not limited thereto in number, and the wiring member 121 may be disposed in each of the rows of the piezoelectric actuators 130. When the one wiring member 121 is disposed with the two rows of the piezoelectric actuators 130 as in this embodiment, a space where the wiring member 121 and the lead electrode 90 are connected with each other can be narrow and the recording head 1 can be compact in size. In a case where the wiring member 121 is disposed in each of the rows of the piezoelectric actuators 130, it is also conceivable to extend the lead electrodes 90 to the side opposite to the rows of the piezoelectric actuators 130. However, in such a configuration, an even wider space is required for the connection of the lead electrode with the wiring member and the number of the areas where the wiring member 121 is drawn out to the case member and the like becomes two, which results the recording head 1 becoming larger in size. In other words, the two rows of the piezoelectric actuators 130 can be connected at the same time with the one wiring member 121 when the lead electrodes 90 are disposed between the two rows of the piezoelectric actuators 130 as in this embodiment. The width direction of the sheet-shaped wiring member 121, which is connected to the lead electrodes 90 in this manner, is arranged in the first direction X.

In addition, the protective substrate 30, which has substantially the same size as the flow path forming substrate 10, is bonded to the surface of the flow path forming substrate 10 on the sides toward the piezoelectric actuators 130, which are the pressure generating units. The protective substrate 30 has holding portions 31, which are spaces in which the piezoelectric actuators 130 are protected. The holding portions 31 are disposed independently in the respective rows configured with the piezoelectric actuators 130 juxtaposed in the first direction X, and a thickness-direction through-hole 32 is disposed between the two holding portions 31 (second direction Y). The other end portions of the lead electrodes 90 extended to be exposed into the through-hole 32, and the lead electrodes 90 and the wiring member 121 are electrically connected with each other in the through-hole 32.

In addition, the case member 40, which defines the manifolds 100 communicating with the plurality of pressure generating chambers 12 along with the head main body 11, is fixed to the head main body 11 having this configuration. The case member 40 has substantially the same shape, in a plan view, as the communicating plate 15 described above, is bonded to the protective substrate 30, and is also bonded to the communicating plate 15 described above. Specifically, the case member 40 has a concave portion 41 with a depth at which the flow path forming substrate 10 and the protective substrate 30 are accommodated on the protective substrate 30 side. The concave portion 41 has an opening area which is larger than that of the surface of the protective substrate 30 bonded to the flow path forming substrate 10. An opening surface of the concave portion 41 on the nozzle plate 20 side is sealed by the communicating plate 15 in a state where the flow path forming substrate 10 and the like are accommodated in the concave portion 41. In this manner, a third manifold portion 42 is defined in an outer circumferential portion of the flow path forming substrate 10 by the case member 40 and the head main body 11. The first manifold portion 17 and the second manifold portion 18 that are disposed on the communicating plate 15 and the third manifold portion 42 that is defined by the case member 40 and the head main body 11 constitute the manifold 100 of this embodiment. In other words, the manifold 100 has the first manifold portion 17, second manifold portion 18, and the third manifold portion 42. In addition, the manifolds 100 according to this embodiment are arranged on both outer sides of the two rows of the pressure generating chambers 12 in the second direction Y, and the two manifolds 100 that are disposed on both of the outer sides of the two rows of the pressure generating chambers 12 are disposed independently of each other so as not to communicate in the head chip 2. In other words, the one manifolds 100 are disposed to communicate with the respective rows (rows juxtaposed in the first direction X) of the pressure generating chambers 12 of this embodiment. In other words, the manifold 100 is disposed for each of the nozzle groups. The two manifolds 100 may communicate with each other.

In addition, in the case member 40, an inlet 44, which is an example of a connection portion, is disposed to communicate with the manifolds 100 and supply ink to the respective manifolds 100. The connection portion is a part that is an inlet of ink supplied to the head chip or an outlet of ink not used in the head chip. In this embodiment, ink is supplied only to the head chip 2 and ink is not discharged from the head chip 2 through circulation. As such, the inlet 44 is formed as the only connection portion in the head chip 2.

An upper surface of the case member 40 is formed to be substantially flat, and the inlet 44 is open to the upper surface. In other words, a part that more protrudes to a downstream flow path member 220 side than the inlet 44 is not present in the case member 40. This configuration of the case member 40 can facilitate an operation for fixing the head chip 2 to an accommodating portion 226 (described in detail later).

In addition, a connection port 43, which communicates with the through-hole 32 of the protective substrate 30 for the wiring member 121 to be inserted, is disposed in the case member 40. The other end portion of the wiring member 121 extends in the direction opposite to the penetration directions of the through-hole 32 and the connection port 43, that is, the third direction Z, which is the direction of discharge of ink droplets.

Examples of the material that can be used in the case member 40 include resins and metals. When a resinous material is molded as the case member 40, mass production is available at a low cost.

In addition, a compliance substrate 45 is disposed on a surface of the communicating plate 15 where the first manifold portion 17 and the second manifold portion 18 are open. The compliance substrate 45 has substantially the same size, in a plan view, as the communicating plate 15 described above, and a first exposing opening portion **45*a* that exposes the nozzle plate 20 is disposed in the compliance substrate 45. The openings of the first manifold portion 17 and the second manifold portion 18 on the liquid ejecting surface 20*a* side are sealed in a state where the compliance substrate 45 exposes the nozzle plate 20 by using the first exposing opening portion 45*a***.

In other words, the compliance substrate 45 defines a part of the manifold 100. The compliance substrate 45 has a sealing film 46 and a fixed substrate 47 in this embodiment. The sealing film 46 is formed of a flexible and film-shaped thin film (for example, a thin film with a thickness of 20 μm or less which is formed of polyphenylene sulfide (PPS) or the like), and the fixed substrate 47 is formed of a hard material such as a metal, examples of which include stainless steel (SUS). An area of the fixed substrate 47 facing the manifold 100 is an opening portion 48 that is completely removed in the thickness direction, and thus one surface of the manifold 100 is a compliance portion 49 that is a flexible portion which is sealed only by the flexible sealing film 46. In this embodiment, one compliance portion 49 is disposed to correspond to one manifold 100. In other words, in this embodiment, the number of the manifolds 100 disposed is two, and thus the number of the compliance portions 49 is two, which are disposed on both sides in the second direction Y across the nozzle plate 20.

When ink is ejected, ink is introduced via the inlet 44 and inner portions of the flow paths reaching the nozzles 21 from the manifolds 100 are filled with ink in the head chip having this configuration. Then, a voltage is applied to the respective piezoelectric actuators 130, which correspond to the pressure generating chambers 12, according to a signal from the drive circuit 120 so that the vibrating plate 50 is subjected to a bending deformation along with the piezoelectric actuators 130. This results in an increase in the pressure in the pressure generating chambers 12, and ink droplets are ejected from the predetermined nozzles 21.

Figure 4:
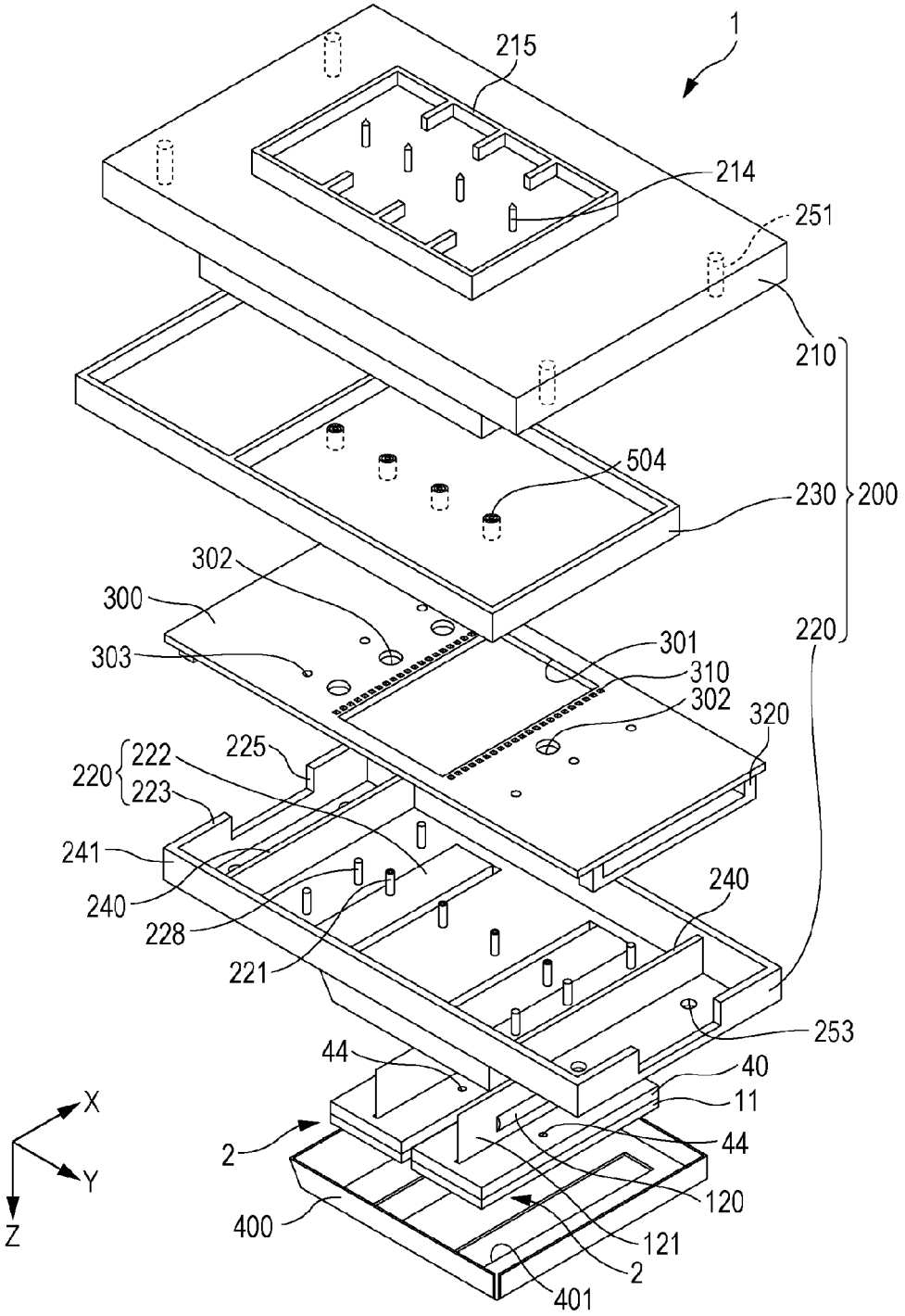
FIG. 4 is an exploded perspective view of a recording head according to the first embodiment.
Figure 5:
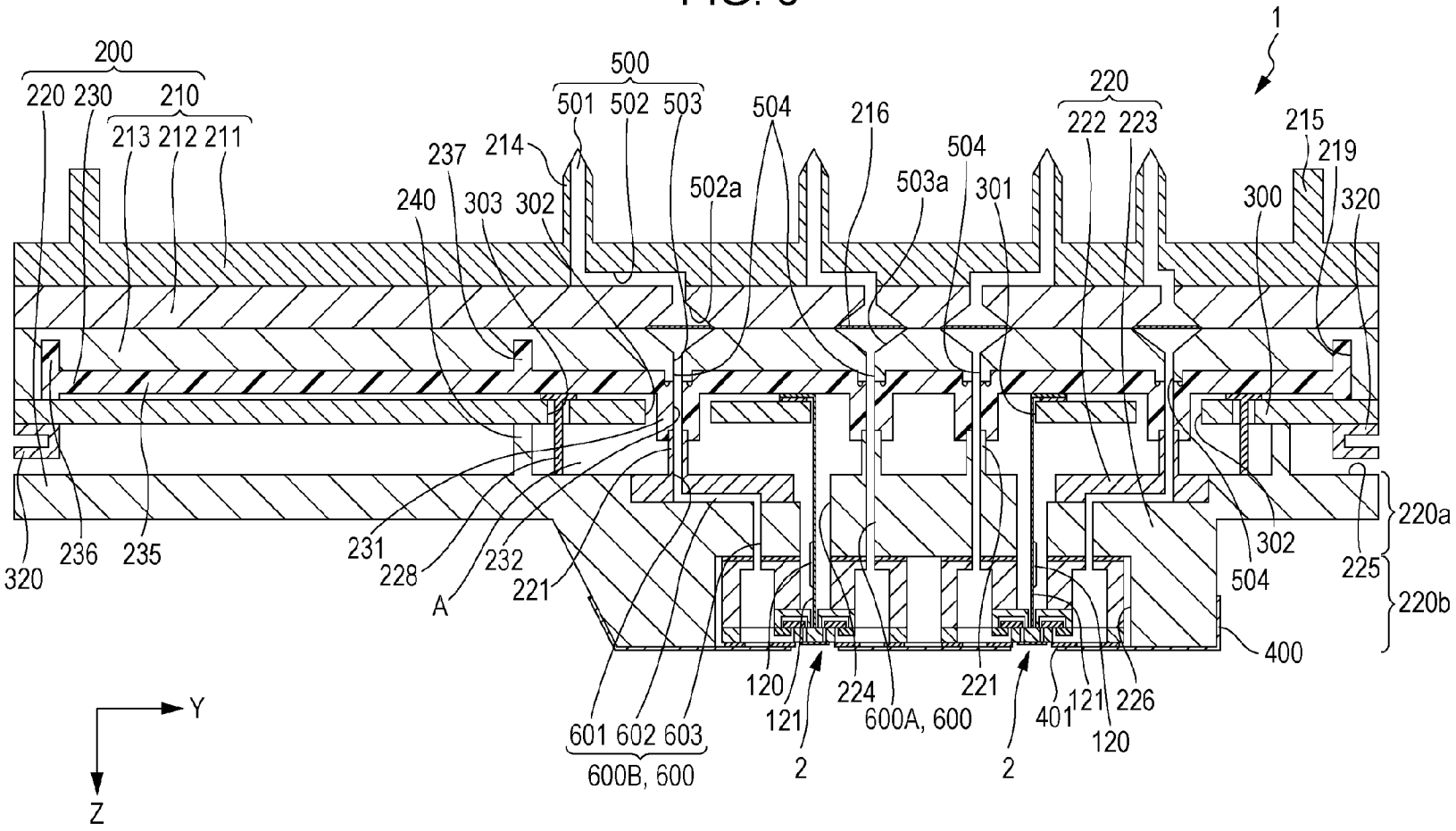
FIG. 5 is a sectional view of the recording head according to the first embodiment.
Figure 6:
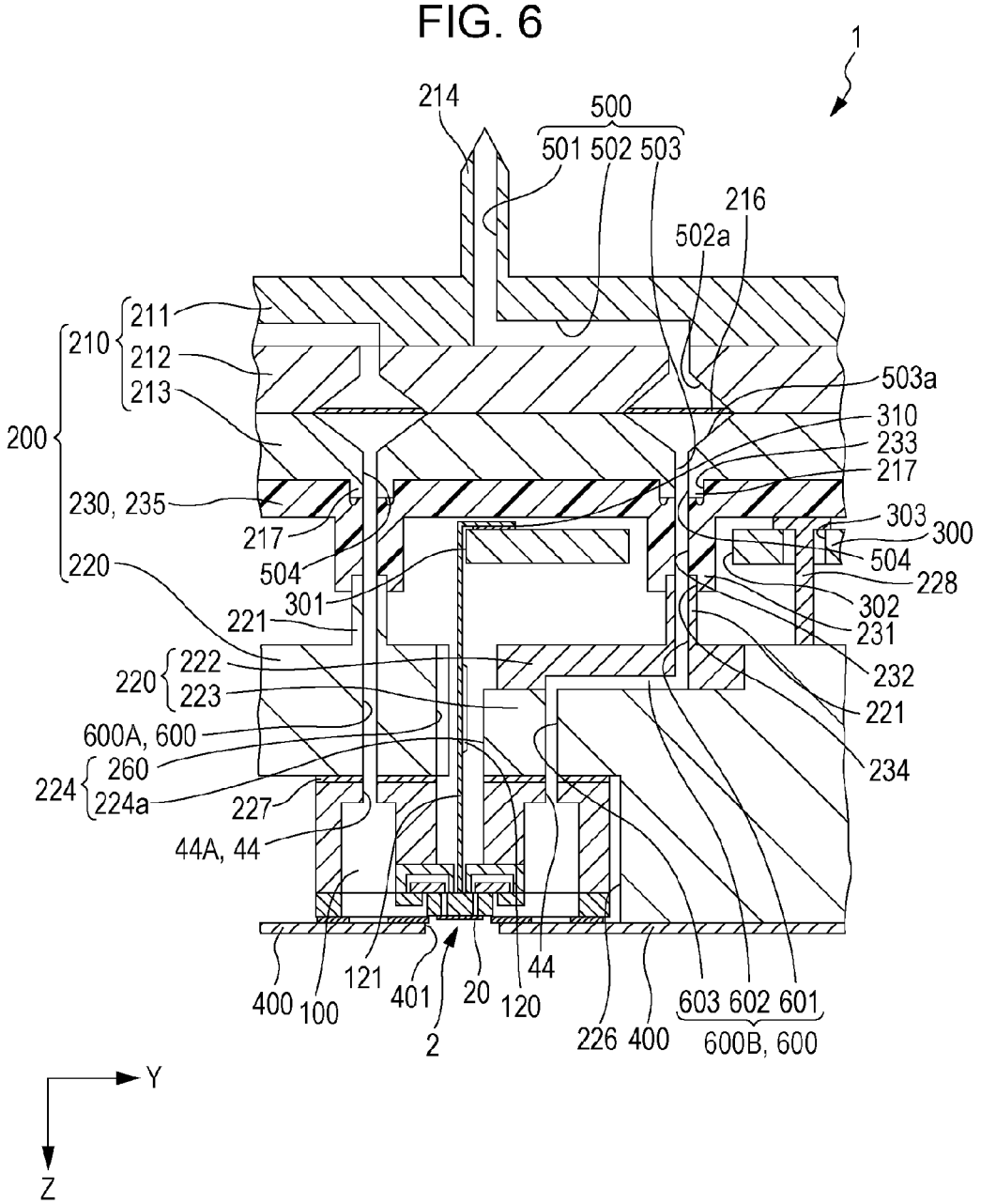
FIG. 6 is an enlarged sectional view of a main part in FIG. 5.
Figure 7A:
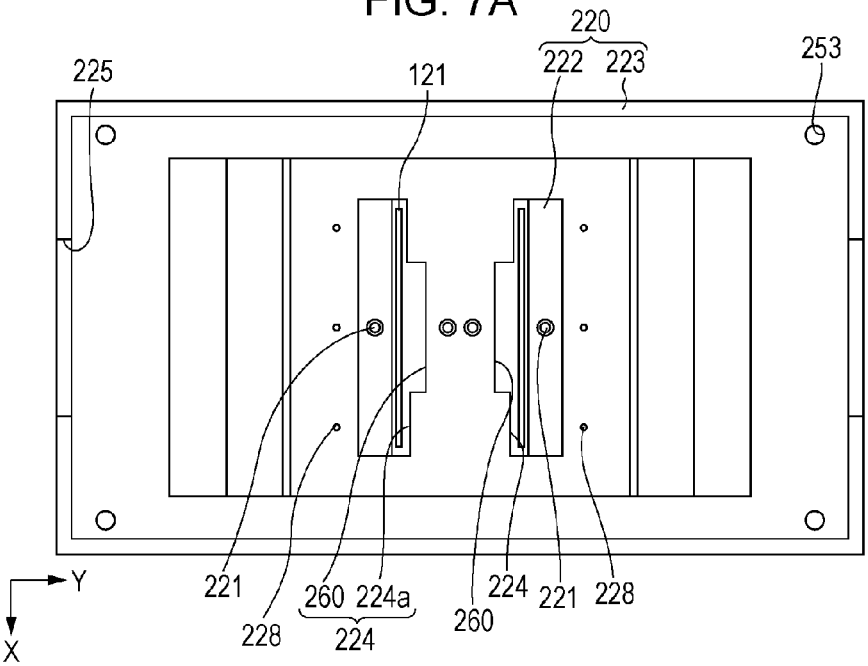
FIGS. 7A and 7B are top views of a wiring substrate side of a downstream flow path member.
Figure 7B:
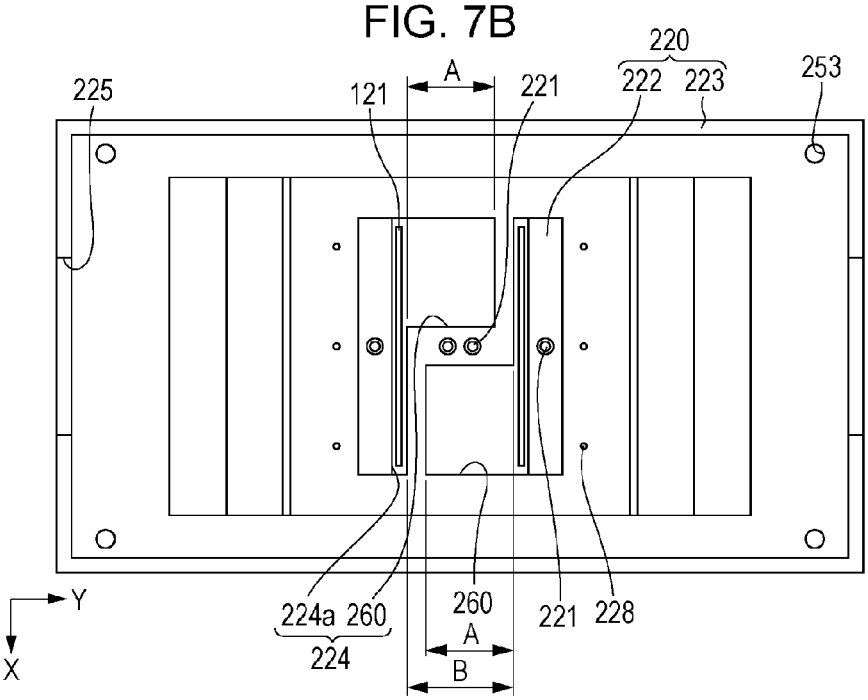

The recording head 1 of this embodiment that includes the head chip 2 will be described in detail. FIG. 4 is an exploded perspective view of the recording head according to the first embodiment. FIG. 5 is a sectional view of the recording head. FIG. 6 is an enlarged sectional view of a main part. FIGS. 7A and 7B are top views of a wiring substrate side of the downstream flow path member.

As illustrated in FIGS. 4 to 6, the recording head 1 includes the two head chips 2 that discharge ink (liquid) as ink droplets (liquid droplets) from the nozzles, a flow path member 200 that holds the two head chips 2 and supplies ink (liquid) to the head chips 2, a wiring substrate 300 that is held by the flow path member 200, and a cover head 400 that is disposed on the liquid ejecting surface **20*a* sides of the head chips 2** and is an example of a fixing member.

The flow path member 200 has an upstream flow path member 210 that is an example of a first flow path member, a downstream flow path member 220 that is an example of a second flow path member, and a seal member 230 that is arranged between the upstream flow path member 210 and the downstream flow path member 220.

The upstream flow path member 210 has an upstream flow path 500 that is an example of a first flow path which is a flow path for ink. In this embodiment, a first upstream flow path member 211, a second upstream flow path member 212, and a third upstream flow path member 213 are stacked in the third direction Z, in which ink droplets are discharged, to constitute the upstream flow path member 210. A first upstream flow path 501, a second upstream flow path 502, and a third upstream flow path 503 are respectively disposed in these members, and are connected to constitute the upstream flow path 500.

The upstream flow path member 210 is not particularly limited thereto, and may be a single member or may be configured by using a plurality of, or two or more, members. In addition, a direction in which the plurality of members constituting the upstream flow path member 210 are stacked is not particularly limited, and may be the first direction X or the second direction Y as well.

The first upstream flow path member 211 has connection portions 214, which are connected to a liquid holding portion such as an ink tank and an ink cartridge where ink (liquid) is held, on the surface side opposite to the downstream flow path member 220. In this embodiment, the connection portions 214 protrude in a needle shape. The liquid holding portion such as the ink cartridge may be directly connected to the connection portions 214, and the liquid holding portion such as the ink tank may be connected via a supply tube such as a tube. First upstream flow paths 501, to which ink is supplied from the liquid holding portion, are disposed in the connection portions 214. In addition, guide walls 215 are disposed around the connection portions 214 of the first upstream flow path member 211 so as to position the liquid holding portion. Flow paths that extend in the third direction Z to correspond to second upstream flow paths 502 (described later), flow paths that extend in planes including the directions orthogonal to the third direction Z, that is, the first direction X and the second direction Y to correspond to second upstream flow paths 502, and the like constitute the first upstream flow paths 501.

The second upstream flow path member 212 is fixed to the surface side of the first upstream flow path member 211 opposite to the connection portions 214 and has the second upstream flow paths 502 which communicate with the first upstream flow paths 501. In addition, first liquid reservoir portions 502*a*, which are widened to be larger in inner diameter than the first upstream flow paths 501, are disposed on the downstream side (third upstream flow path member 213 side) of the second upstream flow paths 502.

The third upstream flow path member 213 is disposed on the side of the second upstream flow path member 212 opposite to the first upstream flow path member 211. In addition, third upstream flow paths 503 are disposed in the third upstream flow path member 213. Opening parts of the third upstream flow paths 503 on the second upstream flow path 502 side are second liquid reservoir portions 503*a*, which are widened to correspond to the first liquid reservoir portions 502*a*, and filters 216 are disposed at opening parts (between the first liquid reservoir portions 502*a* and the second liquid reservoir portions 503*a*) of the second liquid reservoir portions 503*a* so as to remove bubbles and foreign substances contained in ink. As such, ink that is supplied from the second upstream flow paths 502 (first liquid reservoir portions 502*a*) is supplied to the third upstream flow paths 503 (second liquid reservoir portions 503*a*) via the filters 216.

In addition, first protruding portions 217, which protrude toward the downstream flow path member 220 side, are disposed on the downstream flow path member 220 side of the third upstream flow path member 213. The first protruding portion 217 is disposed in each of the third upstream flow paths 503, and the outlets 504 are disposed to be open at respective tip end surfaces of the first protruding portions 217.

The first upstream flow path member 211, the second upstream flow path member 212, and the third upstream flow path member 213 where the upstream flow paths 500 are disposed in this manner are integrally stacked by using, for example, an adhesive and welding. The first upstream flow path member 211, the second upstream flow path member 212, and the third upstream flow path member 213 can also be fixed by using a screw, a clamp, and the like. However, it is preferable that bonding be performed by using an adhesive, welding, and the like so as to suppress the leakage of ink (liquid) from connection parts reaching the third upstream flow paths 503 from the first upstream flow paths 501.

In this embodiment, four connection portions 214 are disposed in one upstream flow path member 210 and four independent upstream flow paths 500 are disposed in one upstream flow path member 210. A total of four inlets 44 are disposed to correspond to the respective upstream flow paths 500. In this embodiment, connection is formed from one of the upstream flow paths 500 to one of the inlets 44 of the head chips 2, but the invention is not limited thereto. For example, the upstream flow path 500 may branch into at least two in the middle and the branching flow paths may be connected to the inlets 44 of the head chip 2.

The downstream flow path member 220 is a member that is bonded to the upstream flow path member 210 and has the accommodating portion 226 where the head chip 2 is accommodated. The upstream flow path member 210 side of the downstream flow path member 220 is referred to as an upper surface side, and the side opposite to the upstream flow path member 210 is referred to as a lower surface side. The downstream flow path member 220 being bonded to the upstream flow path member 210 means not only a direct contact between the upstream flow path member 210 and the downstream flow path member 220 but also a case where the upstream flow path member 210 and the downstream flow path member 220 are indirectly assembled with another component interposed therebetween.

In the downstream flow path member 220, the accommodating portion 226 that is open to the lower surface side, that is, the liquid ejecting surface 20*a* side, is formed as a concave portion where the head chip 2 is accommodated. The accommodating portion 226 according to this embodiment can accommodate the two head chips. In addition, the depth of the accommodating portion 226 (depth in the third direction Z) is slightly greater than the height of the head chip 2.

In addition, the downstream flow path member 220 has a downstream flow path 600 that is an example of a second flow path which is a flow path for ink. A first downstream flow path member 222 and a second downstream flow path member 223 constitute the downstream flow path member 220 according to this embodiment, and the downstream flow path 600 is formed from these members. A downstream flow path 600A and a downstream flow path 600B, which are of two types with different shapes, are configured as the downstream flow path 600.

A first flow path 601 is formed in the first downstream flow path member 222, and a second flow path 602 is formed between the first downstream flow path member 222 and the second downstream flow path member 223. In addition, a third flow path 603 is formed in the second downstream flow path member 223.

Second protruding portions 221 that protrude to the upstream flow path member 210 side are disposed, as a configuration common to both the downstream flow path 600A and the downstream flow path 600B, in the downstream flow path member 220 (each of the first downstream flow path member 222 and the second downstream flow path member 223). The second protruding portion 221 is disposed for each of the upstream flow paths 500, that is, each of the first protruding portions 217. In addition, one end of the downstream flow path 600 is open to a tip end surface of the second protruding portion 221, and the other end of the downstream flow path 600 is disposed to be open to the surface on the side opposite to the upstream flow path member 210 in the third direction Z, that is, a bottom surface portion of the accommodating portion 226.

The downstream flow path 600A is linearly formed in the third direction Z in the second downstream flow path member 223. In addition, the downstream flow path 600B has the first flow path 601 that is connected to the upstream flow path 500 (outlet 504), the second flow path 602 that is connected to the first flow path 601, and the third flow path 603 that connects the second flow path 602 to the inlet 44. The first flow path 601 and the third flow path 603 are formed as through-holes of the second downstream flow path member 223 in the third direction Z. The second flow path 602 is formed as a groove that is formed on one surface of the first downstream flow path member 222 is sealed by the second downstream flow path member 223. When the first downstream flow path member 222 and the second downstream flow path member 223 are bonded, the second flow path 602 can be formed with ease in the downstream flow path member 220.

In addition, the second flow path 602 is an example of an extending flow path that extends toward the second direction Y. Herein, the extension of the second flow path 602 toward the second direction Y means that a component (vector) toward the second direction Y is present in the direction of extension of the second flow path 602. The direction of extension of the second flow path 602 is the direction in which ink (liquid) in the second flow path 602 flows. Accordingly, the second flow path 602 includes those disposed in the horizontal direction (direction orthogonal to the third direction Z) and those disposed to intersect with the third direction Z and the horizontal direction (in-plane direction of the first direction X and the second direction Y). In this embodiment, the first flow path 601 and the third flow path 603 are disposed in the third direction Z and the second flow path 602 is disposed in the horizontal direction (second direction Y). The first flow path 601 and the third flow path 603 may be disposed in the direction intersecting with the third direction Z.

The downstream flow path 600B is not limited thereto, and a flow path other than the first flow path 601, the second flow path 602, and the third flow path 603 may also be present, and the first flow path 601 or the third flow path 603 may not be disposed. In addition, a configuration in which only the second flow path 602 is the extending flow path has been described in the example described above, but, without being limited thereto, a plurality of flow paths that have components in the second direction Y may also be extending flow paths. Furthermore, the entire downstream flow path 600B may be an extending flow path.

The plurality of head chips 2, the two head chips 2 in this embodiment, are accommodated in the accommodating portion 226 of the downstream flow path member 220. The rows of the nozzles are formed to be juxtaposed in the second direction Y in each of the head chips 2 (refer to FIGS. 1 and 2), and the two head chips 2 are disposed to be juxtaposed in the second direction Y in the recording head 1. Hereinafter, the first direction X, the second direction Y, and the third direction Z of the head chip 2 respectively illustrate the same directions as the first direction X, the second direction Y, and the third direction Z of the recording head 1.

The two inlets 44 are disposed in each of the two head chips 2. The downstream flow paths 600 (the downstream flow path 600A and the downstream flow path 600B) that are disposed in the downstream flow path member 220 are disposed to be open and in alignment with the positions where the respective inlets 44 are open.

Each of the inlets 44 of the head chips 2 is aligned to communicate with the downstream flow path 600 that is open to the bottom surface portion of the accommodating portion 226 of the downstream flow path member 220. The head chip 2 is fixed to the accommodating portion 226 with an adhesive 227 that is disposed around each of the inlets 44. When the head chip 2 is fixed to the accommodating portion 226 in this manner, the downstream flow path 600 and the inlet 44 communicate with each other and ink is supplied to the head chip 2.

Herein, each of the inlets 44 is positioned more to the downstream flow path member 220 side than any other part in the head chip 2 as described above. In other words, a site that hinders a contact between the inlet 44 of the head chip 2 and the bottom surface portion of the accommodating portion 226 is not present in the head chip 2. As such, the head chip 2 having this configuration can facilitate an operation for connecting the inlets 44 to the respective downstream flow paths 600 and fixing the head chip 2 to the downstream flow path member 220 with the adhesive 227.

In addition, the inlet 44 of ink supplied to the head chip 2 is a bonding surface (surface on the downstream flow path member 220 side) of the head chip 2 on the side opposite to the liquid ejecting surface 20*a* and the downstream flow path 600 is configured to be open to the bottom surface portion of the accommodating portion 226 in the downstream flow path member 220.

Herein, an assembly operation is performed by placing the downstream flow path member 220 from above the head chip 2, with the inlet 44 of the head chip 2 toward an upper side in a perpendicular direction and the accommodating portion 226 toward a lower side in the perpendicular direction, and aligning the inlet 44 with the opening of the downstream flow path 600.

In this case, no force is added in the horizontal direction to the downstream flow path member 220, and thus a state of alignment with the head chip 2 can be maintained. In other words, this configuration can suppress position shifts of the inlet 44 and the downstream flow path 600 during an operation for assembling the downstream flow path member 220 and the head chip 2. When the bonding surface of the head chip 2 is inclined from a horizontal plane, the downstream flow path member 220 may be shifted with respect to the head chip 2 and an operation and equipment for suppressing the occurrence of the shift are required.

In addition, a second insertion hole 224 is disposed in the downstream flow path member 220. The second insertion hole 224 is disposed to be open to the accommodating portion 226 and the upstream flow path member 210 side of the downstream flow path member 220. The second insertion hole 224 communicates with the connection port 43 of the head chip 2 and allows the wiring member 121 to be inserted from the head chip 2 side to the upstream flow path member 210 side. The second insertion hole 224 is disposed as an opening having the substantially same width as the width of the head chip 2 in the first direction X.

Furthermore, as illustrated in FIGS. 4 to 7A, the second insertion hole 224 that is disposed in the downstream flow path member 220 is formed so that a tool holding the wiring member 121 can be inserted.

The tool holding the wiring member 121 is a tool that can hold the wiring member 121. Specifically, the tool holding the wiring member 121 is a tool, such as tweezers, which pinches the wiring member 121. The tool is used to maintain a state where the wiring member 121 is upright in the third direction Z from the head chip 2 (described in detail later).

The above-described tool being allowed to be inserted into the second insertion hole 224 means that the tool can be inserted with the wiring member 121 with the tool holding the wiring member 121.

In this embodiment, a wiring member insertion portion 224*a* where mainly the wiring member 121 is inserted and a tool insertion portion 260 where mainly the tool is inserted constitute the second insertion hole 224. Both the wiring member insertion portion 224*a* and the tool insertion portion 260 are through-holes that are respectively open to the accommodating portion 226 of the downstream flow path member 220 and the wiring substrate 300 side and are linearly formed in the third direction Z.

The wiring member insertion portion 224*a* is formed to have a width that is slightly larger than the width of the wiring member 121 in the first direction X and the second direction Y. In addition, the tool insertion portion 260 is formed to have a width that is slightly larger than the width of the tool (described later) in the first direction X and the second direction Y.

The wiring member insertion portion 224*a* and the tool insertion portion 260 have a rectangular opening shape in a plan view, are integrally formed so that respective long sides are shared, and constitute the second insertion hole 224 as a single through-hole.

Since the second insertion hole 224 is formed to allow the tool to be inserted in this manner, the tool can be inserted in advance into the tool insertion portion 260 during the assembly of the recording head 1. The wiring member 121 can be inserted into the second insertion hole 224 (wiring member insertion portion 224*a*) when the tool is moved to be separated from the downstream flow path member 220 in a state where the wiring member 121 connected to the head chip 2 on the accommodating portion 226 side is held and the wiring member 121 is held with the tool.

The wiring member 121 can be inserted into the second insertion hole 224 (wiring member insertion portion 224*a*) and an assembly operation can be facilitated just by inserting the tool into the tool insertion portion 260 in the third direction Z in this manner and moving the tool to separate the tool from the downstream flow path member 220 in a state where the wiring member 121 is held.

Herein, it is conceivable that the insertion of the wiring member 121 into the second insertion hole 224 can be facilitated by enlarging the opening shape of the second insertion hole 224. However, when the second insertion hole 224 is simply enlarged, the area that is occupied by the second insertion hole 224 increases on a plane which is formed by the first direction X and the second direction Y, and thus the recording head 1 is unlikely to be compact in size.

As described above, the wiring member insertion portion 224*a* has a size that is required for the wiring member 121 to be inserted and the tool insertion portion 260 has a size that is required for the tool to be inserted. The wiring member insertion portion 224*a* and the tool insertion portion 260 are integrally formed in this manner with the required shapes corresponding to the respective sizes of the wiring member 121 and the tool. As such, the second insertion hole 224 can have a sufficient size that is required for the wiring member 121 to be inserted by using the tool, and the recording head 1 can be compact in size.

FIG. 7B illustrates another aspect of the second insertion hole 224. The two tool insertion portions 260 are juxtaposed to overlap in the second direction Y. In other words, a width B is shorter than the sum of two widths As when each of the widths of the tool insertion portions 260 in the second direction Y is assumed as A and the width occupied in the second direction Y by the two tool insertion portions 260 is assumed as B.

When the second insertion hole 224 is configured in this manner so that the tool insertion portions 260 overlap in the second direction Y (one direction), the width occupied in the second direction Y by the second insertion hole 224 can be shortened and the recording head 1 can be compact in size.

In addition, supporting portions 240 (described later), on which the wiring substrate 300 is mounted, are formed in the downstream flow path member 220. The two supporting portions 240 are disposed to protrude to the upstream flow path member 210 side of the downstream flow path member 220, and are arranged across the second insertion hole 224 in the second direction Y. In addition, a side wall portion 241, which protrudes to the upstream flow path member 210 and surrounds the outer circumference of a surface on the upstream flow path member 210 side, is formed in the downstream flow path member 220. Each of the supporting portions 240 is disposed to connect two facing sides of the side wall portion 241. A space A that surrounds the second insertion hole 224 is formed in this manner by the supporting portions 240 and the side wall portion 241. The wiring substrate 300 is mounted on the supporting portions 240 and the seal member 230 is arranged on the wiring substrate 300 so that the space A is sealed.

The seal member 230, which is a joint connecting (linking) the upstream flow paths 500 and the downstream flow path 600 with each other, is disposed between the upstream flow path member 210 and the downstream flow path member 220. A material that has liquid resistance to a liquid, such as ink, used in the recording head 1 and an elastically deformable material (elastic material), such as rubber and an elastomer, can be used as the material of the seal member 230.

The seal member 230 has a plate-shaped base portion 235, and communicating paths 232 and third protruding portions 231 are formed in the base portion 235. In this embodiment, the numbers of the communicating paths 232 and the third protruding portions 231 formed to correspond to the respective upstream flow paths 500 and the respective downstream flow paths 600 are four.

A first concave portion 233 with an annular shape, into which the first protruding portion 217 is inserted, is disposed on the upstream flow path member 210 side of the base portion 235. The first concave portion 233 is disposed at a position facing the third protruding portion 231.

The third protruding portions 231 protrude to the downstream flow path member 220 side and are disposed at positions facing the second protruding portions 221 of the downstream flow path member 220. A second concave portion 234, into which the second protruding portion 221 is inserted, is disposed on a top surface (surface facing the downstream flow path member 220) of the third protruding portion 231.

The communicating path 232 penetrates the base portion 235 in the thickness direction (third direction Z), and has one end open to the first concave portion 233 and the other end open to the second concave portion 234. The third protruding portion 231 is held, in a state where a predetermined pressure is applied in the third direction Z, between the tip end surface of the first protruding portion 217 that is inserted into the first concave portion 233 and the tip end surface of the second protruding portion 221 that is inserted into the second concave portion 234. The upstream flow path 500 and the communicating path 232 are connected in this manner in a state where pressure is applied in the third direction Z to the seal member 230, and the communicating path 232 and the downstream flow path 600 are connected in a state where pressure is applied in the third direction Z to the seal member 230. Accordingly, the upstream flow path 500 and the downstream flow path 600 communicate in a state where the upstream flow path 500 and the downstream flow path 600 are sealed via the communicating path 232.

Also conceivable is an aspect that allows the upstream flow path 500 and the downstream flow path 600 to communicate by putting the first protruding portion 217 and the second protruding portion 221 into the communicating path 232. In other words, it is conceivable to connect the flow paths by bringing an inner surface of the communicating path 232 of the third protruding portion 231 into close contact with an outer circumferential surface of at least one of the first protruding portion 217 and the second protruding portion 221, that is, by applying pressure in the first direction X that is a radial direction and a plane direction of the second direction Y.

In this case, each of the sites constituting the recording head 1 may be an obstacle in applying pressure in the radial direction. For example, pressure has to be applied in the radial direction in the first insertion hole 301, into which the wiring member 121 and the like are inserted, in a case where pressure is applied in the radial direction to the inner surface of the communicating path 232 and the second protruding portion 221. This makes the operation difficult.

However, the upstream flow path member 210 is not present yet above the seal member 230 in the third direction Z in a state where the wiring substrate 300 is arranged on the downstream flow path member 220 and the seal member 230 is arranged on the wiring substrate 300 (described in detail later). As such, pressure can be applied in the third direction Z to the seal member 230 and an operation for allowing the communicating path 232 to communicate with the downstream flow path 600 can be facilitated. This is similar to an operation for allowing the upstream flow path 500 to communicate with the communicating path 232 by applying pressure in the third direction Z with the upstream flow path member 210 arranged on the seal member 230.

In addition, a wall portion 236, which is formed to surround an outer circumference of the base portion 235 and protrudes to the upstream flow path member 210 side, is formed in the seal member 230. In this embodiment, the wall portion 236 is formed to have a quadrangular shape in a plan view to match with the substantially quadrangular base portion 235. Furthermore, a beam portion 237, which connects the facing wall portions 236, is formed on the upstream flow path member 210 side of the base portion 235.

The wall portion 236 and the beam portion 237 resist a force to twist the base portion 235, and thus the twisting of the base portion 235 can be suppressed. The wall portion 236 and the beam portion 237 are disposed in the plate-shaped base portion 235 of the seal member 230 in this manner, and thus the base portion 235 is configured to be unlikely to be subjected to twisting. As such, the handling of the seal member 230 can be facilitated and an operation for arranging the seal member 230 between the upstream flow path member 210 and the downstream flow path member 220 can be facilitated. When the seal member has an annular shape and parts corresponding to the wall portion 236 and the beam portion 237 are not disposed, the seal member is twisted and efforts are taken to correct the seal member.

In addition, the wall portion 236 is pinched by the upstream flow path member 210 and the wiring substrate 300. In other words, an upper surface (surface on the upstream flow path member 210 side) of the wall portion 236 is pressed against the upstream flow path member 210 and a lower surface (surface on the wiring substrate 300 side) of the wall portion 236 is pressed against the wiring substrate 300. As such, a boundary part between the upstream flow path member 210 and the base portion 235 inside the wall portion 236 remains airtight and the evaporation of moisture in ink from the flow paths (the upstream flow path 500, the communicating path 232, and the downstream flow path 600) is suppressed.

Herein, a groove portion 219 is formed in the upstream flow path member 210 so as to suppress a failure in maintaining airtightness caused by the inclination or collapse of the wall portion 236 due to pressure at which the upstream flow path member 210 and the wiring substrate 300 are pinched.

Figure 8A:
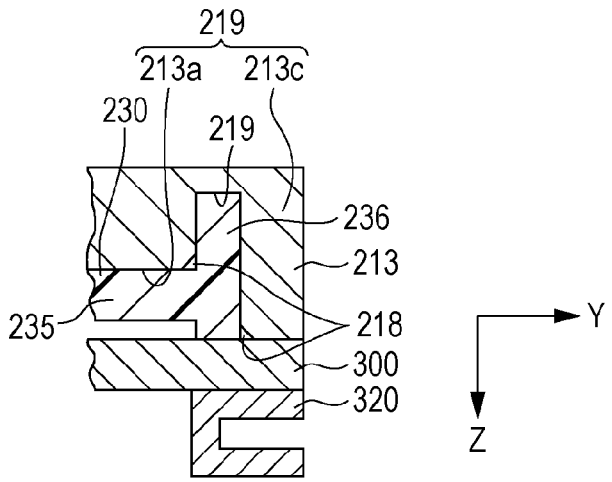
FIGS. 8A to 8C are enlarged sectional views of a wall portion of the recording head according to the first embodiment.
Figure 8B:
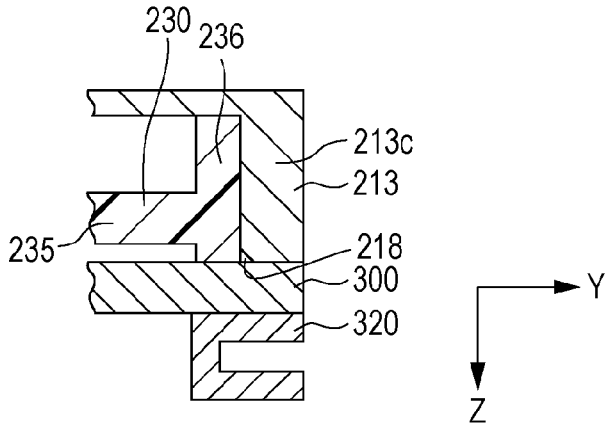
Figure 8C:
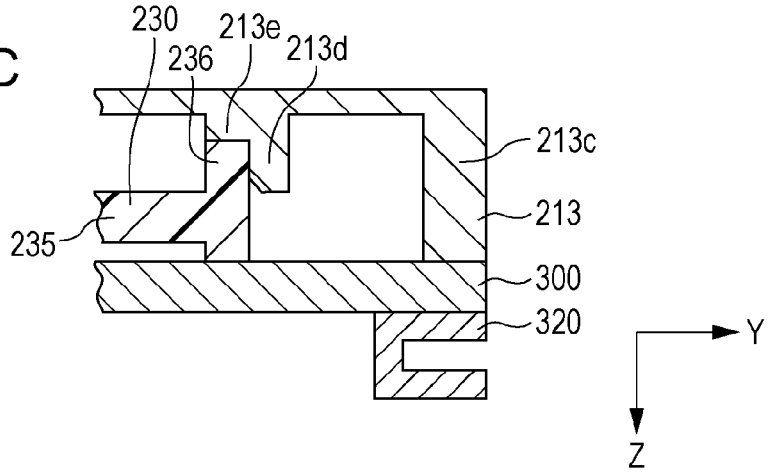

FIGS. 8A to 8C are enlarged sectional views of the wall portion of the recording head. As illustrated in FIG. 8A, the groove portion 219, into which the wall portion 236 is fitted, is formed in the third upstream flow path member 213.

Specifically, the third upstream flow path member 213 has a flat portion 213*a* that is in contact with the base portion 235, a concave portion 213*b* that is more recessed to the second upstream flow path member 212 side than the flat portion 213*a* outside the flat portion 213*a*, and a leg portion 213*c* that protrudes more to the seal member 230 side than the flat portion 213*a* outside the concave portion 213*b*.

The groove portion 219 is formed as the concave portion 213*b* is formed between the flat portion 213*a* and the leg portion 213*c*. The groove portion 219 is formed on a surface of the third upstream flow path member 213 on the seal member 230 side to match with the wall portion 236 which is formed to have an annular shape in a plan view. In addition, an opening portion 218 of the groove portion 219, that is, a boundary part between the flat portion 213*a* and the concave portion 213*b* is chamfered. Furthermore, the seal member 230 side of the surface of the leg portion 213*c* facing the wiring substrate 300 is chamfered.

The wall portion 236 is fitted into the groove portion 219. In this manner, a lateral inclination or collapse of the wall portion 236 due to pressure in the third direction Z given by the upstream flow path member 210 and the wiring substrate 300 is regulated by the groove portion 219.

Since the inclination and collapse of the wall portion 236 is regulated in this manner, the generation of a gap between the upper surface of the wall portion 236 and the third upstream flow path member 213 can be suppressed and the wall portion 236 can remain airtight inside.

Furthermore, the opening portion 218 of the groove portion 219 is chamfered and the surface of the leg portion 213*c* facing the wiring substrate 300 is also chamfered in the third upstream flow path member 213. As such, the wall portion 236 can be guided into the groove portion 219 when the third upstream flow path member 213 (upstream flow path member 210) is bonded to the seal member 230 arranged on the wiring substrate 300 from above in the third direction Z.

Herein, an operation for assembling the third upstream flow path member 213 is performed by arranging the seal member 230 on the wiring substrate 300 and arranging the third upstream flow path member 213 (upstream flow path member 210) on the seal member 230 so that the wall portion 236 is fitted into the groove portion 219.

In this case, no force is added in the horizontal direction to the seal member 230, and thus a state where each of the communicating paths 232 of the seal member 230 is aligned in the downstream flow path 600 can be maintained. In other words, according to this configuration, position shifts of the communicating path 232 and the downstream flow path 600 can be suppressed during an operation for assembling the third upstream flow path member 213 and the seal member 230. When a bonding surface between the seal member 230 and the third upstream flow path member 213 is inclined from a horizontal plane, the seal member 230 may be shifted in position. In order to suppress the shift, an additional operation and equipment for holding the seal member 230 are required.

When the wall portion 236 is disposed in the seal member 230 and the groove portion 219 is disposed in the third upstream flow path member 213 in this manner, an operation for arranging the third upstream flow path member 213 (upstream flow path member 210) on the seal member 230 can be facilitated.

The configuration for suppressing the inclination and collapse of the wall portion 236 is not limited to the aspect illustrated in FIG. 8A. For example, in an alternative aspect, the leg portion 213*c* that is in contact with an outer side of the wall portion 236 may be disposed in the third upstream flow path member 213 as illustrated in FIG. 8B. According to this aspect, the leg portion 213*c* can suppress the inclination and collapse of the wall portion 236 to an outer side (leg portion 213*c* side).

In addition, a rib 213*d* as well as the leg portion 213*c* may be disposed in the third upstream flow path member 213, as illustrated in FIG. 8C, so as to suppress the inclination and collapse of the seal member 230.

Specifically, the rib 213*d*, which protrudes to the wiring substrate 300 side, is formed on a more inner side than the leg portion 213*c* on the seal member 230 side of the third upstream flow path member 213. The rib 213*d* is formed to have an annular shape in a plan view and is large enough for the seal member 230 to be accommodated inside. A rib 213*e*, which succeeds the rib 213*d*, is formed inside the rib 213*d*. The rib 213*e* is a site against which the upper surface of the wall portion 236 abuts, and is recessed more to the second upstream flow path member 212 side than the rib 213*d*.

The upper surface of the wall portion 236 abuts against the rib 213*e*, and a side surface of the wall portion 236 on the outer side abuts against the rib 213*d*.

Even in the third upstream flow path member 213 of this aspect, the inclination and collapse of the wall portion 236 to an outer side (leg portion 213*c* side) can be suppressed by the rib 213*d*.

As illustrated in FIGS. 4 to 6, the wiring substrate 300, to which the wiring member 121 is connected, is disposed between the seal member 230 and the downstream flow path member 220. Not only the wiring member 121 but also the third protruding portion 231 of the seal member 230 is inserted into the first insertion hole 301 of the wiring substrate 300 according to this embodiment. In addition, a through-hole 302, into which only the third protruding portion 231 of the seal member 230 is inserted, is disposed in the wiring substrate 300.

In other words, the first insertion hole 301 that is an opening portion into which two of the four third protruding portions 231 and the wiring member 121 are inserted and the through-holes 302 that are opening portions into which the other two third protruding portions 231 are respectively inserted are disposed in this embodiment.

In addition, the first insertion hole 301 is formed to allow the tool holding the wiring member 121 to be inserted as is the case with the second insertion hole 224. The first insertion hole 301 according to this embodiment has a substantially quadrangular shape, has a size that allows the two wiring members 121 to be inserted, and allows the tool holding the wiring member 121 to be inserted. In addition, the wiring substrate 300 is arranged so that the two second insertion holes 224 which are formed in the downstream flow path member 220 are received in the first insertion hole 301 in a plan view. Since the two downstream flow paths 600 of the two head chips 2 are disposed between the two wiring members 121, the third protruding portions 231 of the seal member 230 that correspond to the downstream flow paths 600 are inserted into the first insertion hole 301 with the wiring members 121.

In addition, the through-hole 302 is disposed for each of the third protruding portions 231 that are disposed to correspond to two of the four downstream flow paths 600.

In this embodiment, the one wiring substrate 300 that is common to the two head chips 2 is disposed. However, the invention is not limited thereto, and the wiring substrate 300 may be disposed in a divided manner for each one of the head chips 2.

When the one wiring substrate 300 that is common to the two head chips 2 is used as in this embodiment, the number of components can be reduced and an assembly operation can be simplified.

In addition, the first insertion hole 301 can be disposed with a wider opening area when the two wiring members 121 and the two third protruding portions 231 are inserted into the first insertion hole 301, which is one of opening portions of the wiring substrate 300, than in a case where a plurality of the opening portions are disposed. As such, the wiring member 121 can be drawn out with ease from the first insertion hole 301 and assemblability can be improved. In other words, the wiring member 121 has to be drawn out from the head chip 2 side of the wiring substrate 300 to the upstream flow path member 210 side so that the wiring member 121 and the wiring substrate 300 are connected to each other, it is difficult to insert the wiring substrate 300, which has flexibility, into a narrow opening.

In addition, the wiring member 121 that is inserted into the one first insertion hole 301, which is one of the opening portions of the wiring substrate 300, is in an upright state in the third direction Z and the two second protruding portions 221, which face the first insertion hole 301, are disposed in a linear shape in the third direction Z. As such, the opening area of the first insertion hole 301 can be as small as possible.

In addition, on the upstream flow path member 210 side surface of the wiring substrate 300, terminal portions 310, to which the wiring member 121 is connected, are disposed in open edge portions on both sides of the first insertion hole 301 in the second direction Y. The terminal portions 310 are formed over a width that is substantially equal to the width of the wiring member 121 in the first direction X. The terminal portion 310 is formed not beyond the through-hole 302 into which the third protruding portion 231 is inserted. In other words, the terminal portion 310 is disposed between the first insertion hole 301 and the through-hole 302.

The other end portion of the wiring member 121 is inserted into the first insertion hole 301 of the wiring substrate 300 from the downstream flow path member 220 side. The other end portion of the wiring member 121 that is inserted into the first insertion hole 301 in this manner is bent in the second direction Y on the surface (surface on the upstream flow path member 210 side) of the wiring substrate 300 and is connected to the terminal portions 310 on the surface of the wiring substrate 300 on the upstream flow path member 210 side. In other words, the surface of the connection between the wiring member 121 and the wiring substrate 300 (terminal portions 310) is in the in-plane direction of the first direction X and the second direction Y.

When the other end portion of the wiring member 121 is bent in this manner, the wiring member 121 can have a low back and the recording head 1 can be compact in size in the third direction Z.

In addition, the wiring member 121 and the wiring substrate 300 are connected on the surface of the wiring substrate 300 on the upstream flow path member 210 side such that the wiring member 121 is connected to the terminal portion 310 along the surface of the wiring substrate 300. In other words, the wiring member 121 and the terminal portion 310 of the wiring substrate 300 are connected to overlap in the third direction Z.

When the wiring member 121 and the terminal portion 310 of the wiring substrate 300 are connected at the position overlapping in the third direction Z, the connection between the wiring member 121 and the wiring substrate 300 can be performed with ease from the one surface (upstream flow path member 210) side and assemblability can be improved. In other words, the assembly can be facilitated and the wiring member 121 and the wiring substrate 300 can be connected with ease when the head chip 2 is fixed to the downstream flow path member 220, the wiring member 121 is inserted into the second insertion hole 224 and inserted into the first insertion hole 301 of the wiring substrate 300, and then the end portion of the wiring member 121 inserted into the first insertion hole 301 and the second insertion hole 224 is connected to the wiring substrate 300. For example, the wiring member 121 and the wiring substrate 300 are required to be connected in advance and then the head chip 2 is required to be fixed to the downstream flow path member 220 in order to connect the wiring member 121 with the wiring substrate 300 on the surface of the wiring substrate 300 on the downstream flow path member 220 side. In a case where the assembly is performed through this process, the wiring member 121 has to be lengthened so that the connected state can be maintained between the wiring member 121 and the wiring substrate 300 even in a state where the head chip 2 and the downstream flow path member 220 are not fixed, which results in high costs. In addition, when the head chip 2 and the downstream flow path member 220 are fixed, deflection occurs in the lengthened wiring member 121, the wiring on the wiring member 121 is subjected to damage due to contact with other members, and inconvenience such as disconnection and a short circuit may occur. In this embodiment, the wiring member 121 and the wiring substrate 300 are connected on the surface of the wiring substrate 300 on the upstream flow path member 210 side so that the wiring member 121 and the terminal portion 310 of the wiring substrate 300 overlap in the third direction Z, and thus deflection is unlikely to occur after the assembly of the wiring member 121 and the wiring member 121 can be disposed at the shortest distance (length) at which the head chip 2 and the wiring substrate 300 are linked. Accordingly, the costs can be reduced.

In addition, in the downstream flow path member 220, caulking pins 228 are disposed to be upright on the wiring substrate 300 side. The caulking pins 228 are formed of a resin or the like that can be deformed through heating. In this embodiment, the six caulking pins 228 are formed integrally with the downstream flow path member 220.

Six caulking holes 303 are formed in the wiring substrate 300 for the caulking pins 228 to be inserted.

The caulking pin 228 is inserted into the caulking hole 303, and a top portion 228*a* of the caulking pin 228 is subjected to a thermal deformation to be larger than the caulking pin 228 in opening diameter. As such, the wiring substrate 300 that is mounted on the downstream flow path member 220 is fixed to the downstream flow path member 220 by the caulking pins 228.

In addition, the caulking pins 228 and the caulking holes 303 are also used to determine a predetermined position of the wiring substrate 300. The predetermined position of the wiring substrate 300 described herein is a position where the second protruding portion 221 of the downstream flow path member 220 faces the first insertion hole 301 and the through-hole 302 of the wiring substrate 300, that is, a position where each of the second protruding portions 221 appears in the first insertion hole 301 and the through-hole 302 in a plan view.

Each of the caulking holes 303 and the caulking pins 228 is formed so that the wiring substrate 300 is at the predetermined position described above in a state where the caulking pin 228 is inserted into the caulking hole 303.

Accordingly, the wiring substrate 300 can be arranged at the predetermined position described above when the wiring substrate 300 is moved for the caulking pin 228 to be inserted into the caulking hole 303. Since the caulking pins 228 and the caulking holes 303 guide the wiring substrate 300 to be arranged at a predetermined position in this manner, the wiring substrate 300 can be positioned in and fixed to the downstream flow path member 220 with ease.

In addition, the seal member 230 and the upstream flow path member 210 are not present yet above the caulking pins 228 in the third direction Z in a state where the wiring substrate 300 is arranged on the downstream flow path member 220 and the caulking pins 228 are inserted into the caulking holes 303 (described in detail later). As such, a thermal caulking operation using a tool such as a heat tool can be performed with ease from above the caulking pins 228.

A configuration in which the wiring substrate 300 is fixed to the downstream flow path member 220 is not limited to the caulking pin 228 and the caulking hole 303 described above, but may be adhesion using an adhesive or fixing using a screw and the like. Also, a claw portion may be disposed in the downstream flow path member 220 so that the fixing is performed by engaging the claw portion with the wiring substrate 300.

As described above herein, the first insertion hole 301 and the through-hole 302, into which the third protruding portion 231 disposed in the seal member 230 is inserted, are formed in the wiring substrate 300.

The through-hole 302 is also used to determine a predetermined position of the seal member 230. The predetermined position of the seal member 230 described herein is a position at a time when the third protruding portion 231 faces the second protruding portion 221 of the downstream flow path member 220.

The seal member 230 can be arranged at the predetermined position described above when the seal member 230 is moved so that the third protruding portion 231 is inserted into the through-hole 302 of the wiring substrate 300 in a state where the wiring substrate 300 is fixed to the downstream flow path member 220 by the caulking hole 303 and the caulking pin 228 as described above. Since the first insertion hole 301 and the through-hole 302 guide the seal member 230 to be arranged at a predetermined position in this manner, the seal member 230 can be positioned in and fixed to the downstream flow path member 220 with ease.

In addition, the upstream flow path member 210 is not present yet above the seal member 230 in the third direction Z in a state where the seal member 230 is arranged on the wiring substrate 300 and the third protruding portion 231 is inserted into the first insertion hole 301 and the through-hole 302 (described in detail later). As such, an operation for arranging the seal member 230 can be performed with ease.

Wiring (not illustrated), electronic components (not illustrated), and the like are mounted on the wiring substrate 300, and the wiring that is connected to the terminal portions 310 is connected to connectors 320 that are disposed on both end portion sides in the second direction Y. External wiring (not illustrated) is connected to the connectors 320. A connector connection port 225 that exposes the connectors 320 is disposed in the downstream flow path member 220, and the external wiring is connected to the connectors 320 that are exposed by the connector connection port 225.

In addition, the cover head 400, which is an example of a fixing member, is mounted on the accommodating portion 226 side of the downstream flow path member 220.

The cover head 400 is a member to which the head chip 2 is fixed and a member that is fixed to the downstream flow path member 220, and a second exposing opening portion 401, which exposes the nozzles 21, is disposed in the cover head 400. In this embodiment, the second exposing opening portion 401 has a sufficient size to expose the nozzle plate 20, that is, an opening substantially the same as the first exposing opening portion 45*a* of the compliance substrate 45.

The cover head 400 is bonded to the surface side of the compliance substrate 45 opposite to the communicating plate 15 and seals the space on the side of the compliance portion 49 opposite to the flow path (manifold 100). When the compliance portion 49 is covered by the cover head 400 in this manner, breakage of the compliance portion 49 attributable to contact with a recording medium such as paper can be suppressed. In addition, attachment of ink (liquid) to the compliance portion 49 can be suppressed, ink (liquid) attached to a surface of the cover head 400 can be wiped with, for example, a wiper blade, and contamination of the recording medium by ink attached to the cover head 400 or the like can be suppressed. Although not particularly illustrated, a space between the cover head 400 and the compliance portion 49 is open to the atmosphere. The cover head 400 may also be disposed independently in each of the head chips 2.

The cover head 400, to which the two head chips 2 are fixed in this manner, is fixed to the lower surface side (liquid ejecting surface 20*a* side) of the downstream flow path member 220.

The head chip 2 is smaller than each of the components constituting the recording head 1. Accordingly, it is difficult to perform an operation for holding the head chip 2 and mounting the head chip 2 on the other members. However, the two head chips 2 can be accommodated in the accommodating portion 226 and can be fixed at the same time when the two head chips 2 are fixed to the cover head 400 and then the cover head 400 is fixed to the downstream flow path member 220. In other words, the two head chips 2, which are hard to handle, do not have to be individually accommodated in the accommodating portion 226.

When the cover head 400, to which the head chips 2 are fixed in this manner, is adopted, the plurality of head chips 2 can be accommodated in the accommodating portion 226 at the same time. Accordingly, an operation for assembling the recording head 1 can be facilitated.

As described above herein, the space A that is formed by the seal member 230, the wiring substrate 300, and the downstream flow path member 220 communicates with the accommodating portion 226 via the second insertion hole 224. Since the cover head 400 is fixed to the downstream flow path member 220, the accommodating portion 226 is sealed (the second exposing opening portion 401 that is disposed in the cover head 400 is sealed by the head chip 2 and does not communicate with the accommodating portion 226).

When the seal member 230 is arranged in the downstream flow path member 220 and the accommodating portion 226 is sealed with the cover head 400 in this manner, the space A, which is formed below the seal member 230 in the third direction Z, can be blocked from the outside. As such, in the space A, the evaporation of moisture in ink via, for example, a gap between the communicating path 232 of the seal member 230 and the second protruding portion 221 can be suppressed.

In addition, the accommodating portion 226, which is open to the side opposite to the upstream flow path member 210, is disposed in the downstream flow path member 220. The downstream flow path member 220 having this configuration is a site where an upper surface portion 220*a* on the upstream flow path member 210 side is subjected to pressure from above, and is configured so that a leg portion 220*b*, which forms the accommodating portion 226, provides rigidity for the upper surface portion 220*a*.

As described above, pressure in the third direction Z is applied to the seal member 230 so as to allow the communicating path 232 which is formed in the third protruding portion 231 to communicate with the upstream flow path 500 and the downstream flow path 600.

In a case where each of the head chips 2 is mounted on the lower surface side of the plate-shaped downstream flow path member with the accommodating portion 226 not disposed, the upper surface portion 220*a* is bent due to pressure in the third direction Z applied to the seal member 230 and stress is generated in the head chip 2, which may result in the breakage of the head chip 2 and the peeling of the bonding portion between the head chip 2 and the downstream flow path member.

However, since the accommodating portion 226 is disposed in the downstream flow path member 220, the bending of the upper surface portion 220*a* due to pressure in the third direction Z can be suppressed with the rigidity of the leg portion 220*b*. Accordingly, the generation of stress in the head chip 2 accommodated in the accommodating portion 226 can be suppressed.

In addition, reference marks that define relative positions of the cover head 400 and the downstream flow path member 220 may be formed in the cover head 400 and the downstream flow path member 220. The relative positions of the cover head 400 and the downstream flow path member 220 refer to the positions of the cover head 400 and the downstream flow path member 220 at a time when each of the head chips 2 fixed to the cover head 400 is accommodated in the accommodating portion 226 of the downstream flow path member 220 and the inlet 44 of each of the head chips 2 is connected to the downstream flow path 600.

The reference marks defining the relative positions of the cover head 400 and the downstream flow path member 220 means that the cover head 400 and the downstream flow path member 220 are arranged at the relative positions if the reference marks respectively disposed at the cover head 400 and the downstream flow path member 220 have a predetermined positional relationship.

A method for forming the reference mark is not particularly limited, and may be any method that allows, for example, optical recognition. Specific examples thereof may include printing with ink or the like and a pattern produced by cutting or the like of surfaces of the cover head 400 and the downstream flow path member 220.

Figure 9:
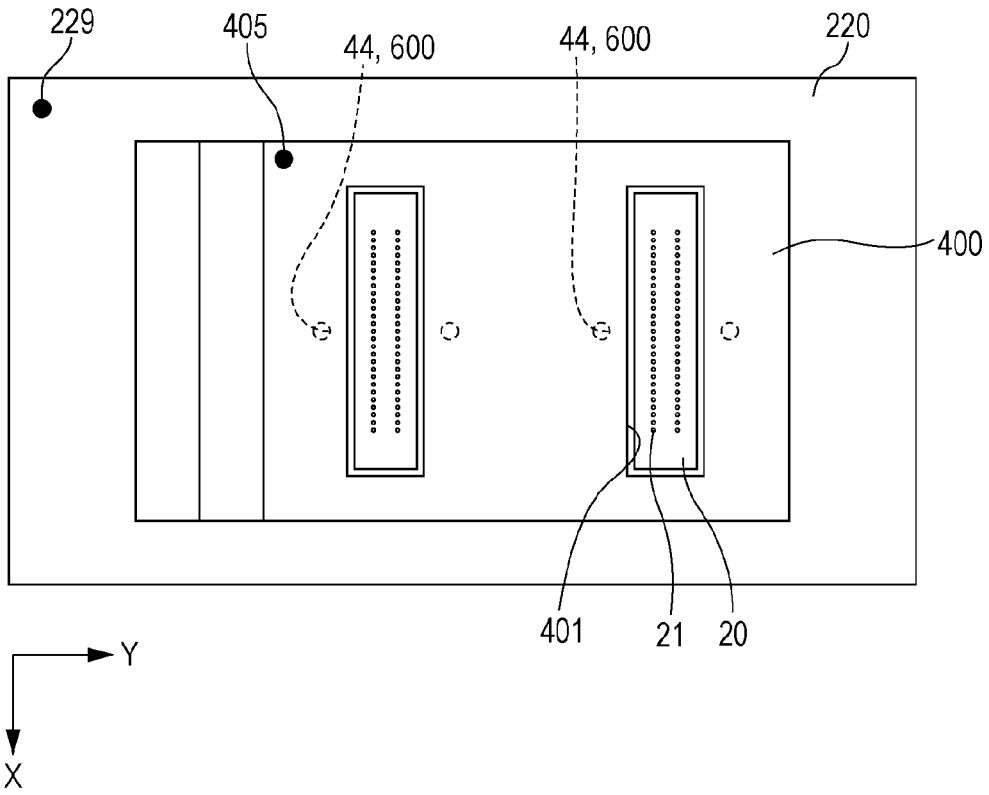
FIG. 9 is a bottom view of the recording head according to the first embodiment.

FIG. 9 is a bottom view of the recording head. As illustrated in the drawing, a first reference mark 229 is disposed on a bottom surface (surface defined by the first direction X and the second direction Y) of the downstream flow path member 220 toward the third direction Z in this embodiment. In addition, a second reference mark 405 is disposed on a bottom surface (surface on the side opposite to the head chip 2) of the cover head 400.

The first reference mark 229 is disposed at a predetermined distance apart, in each of the first direction X and the second direction Y, from the opening of the downstream flow path 600 that is open to the accommodating portion 226 in a bottom view of the downstream flow path member 220.

The second reference mark 405 is disposed at a predetermined distance apart, in each of the first direction X and the second direction Y, from the inlet 44 in a bottom view of the cover head 400.

The first reference mark 229 indirectly illustrates the position of the downstream flow path 600 and the second reference mark 405 indirectly illustrates the position of the inlet 44. Accordingly, the inlet 44 can be arranged to communicate with the downstream flow path 600, that is, a state where the cover head 400 and the downstream flow path member 220 are arranged at the relative positions can be achieved when the first reference mark 229 and the second reference mark 405 adjust the positions of the cover head 400 and the downstream flow path member 220 for a predetermined arrangement on a plane formed by the first direction X and the second direction Y. The head chip 2 is accommodated in the accommodating portion 226 and the cover head 400 is fixed to the downstream flow path member 220 in a state where the relative positions are maintained.

When the first reference mark 229 and the second reference mark 405 are disposed in this manner, the cover head 400 and the downstream flow path member 220 can be easily arranged at the relative positions. A method for a predetermined arrangement of the first reference mark 229 and the second reference mark 405 is not particularly limited. For example, an imaging unit that images the cover head 400 and the downstream flow path member 220 from a bottom surface side can be used. The first reference mark 229 and the second reference mark 405 can be imaged by the imaging unit and the position of the downstream flow path member 220 can be adjusted with a micrometer or the like so that the images have a predetermined arrangement.

In addition, a method for fixing each of the head chip 2, the cover head 400, and the downstream flow path member 220 is performed by fixing the cover head 400, to which the head chip 2 is fixed, to the downstream flow path member 220 (described in detail later).

Specifically, the downstream flow path member 220 is pressed to the head chip 2 side from above in the third direction Z in a state where the cover head 400, to which the head chip 2 is fixed, is mounted and in a state where the cover head 400 and the downstream flow path member 220 maintain the relative positions.

The adhesive 227 is disposed on the upper surface of the head chip 2 where the inlet 44 is disposed, and is adhered to the bottom surface of the accommodating portion 226 to which the downstream flow path 600 is open. The depth of the accommodating portion 226 in the third direction Z is formed to be slightly greater than the height (height from the liquid ejecting surface 20*a* to the inlet 44 in the third direction Z) of the head chip 2.

Accordingly, a slight gap is formed between an opening edge portion of the inlet 44 of the head chip 2 and an opening edge portion of the downstream flow path 600 open to the bottom surface of the accommodating portion 226. However, the adhesive 227 is disposed in this gap, and thus the inlet 44 and the downstream flow path 600 communicate with each other without a gap.

In other words, even when the depth of the accommodating portion 226 and the height of the head chip 2 do not exactly match each other, the difference is covered by the adhesive 227 and thus the inlet 44 of the head chip 2 and the downstream flow path 600 open to the bottom surface of the accommodating portion 226 can communicate with each other without a gap.

In addition, the accommodating portion 226, which is open to the side opposite to the upstream flow path member 210, is disposed in the downstream flow path member 220. An operation for pressing and fixing the downstream flow path member 220 to the head chip 2 side from above the cover head 400 to which the head chip 2 is fixed can be performed with ease.

A method for fixing the downstream flow path member 220 and the head chip 2 is not limited to the adhesion with the adhesive 227, and examples thereof may include fixing by using a screw or the like.

Figure 10:
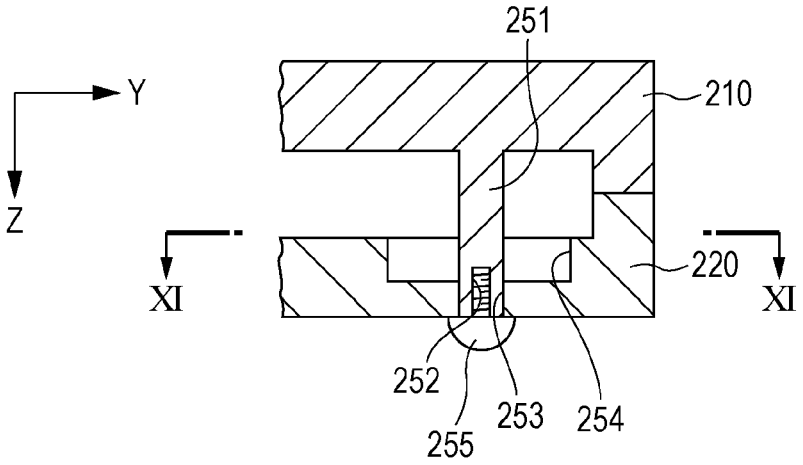
FIG. 10 is a sectional view of a main part of a bonding portion between an upstream flow path member and the downstream flow path member.
Figure 11:
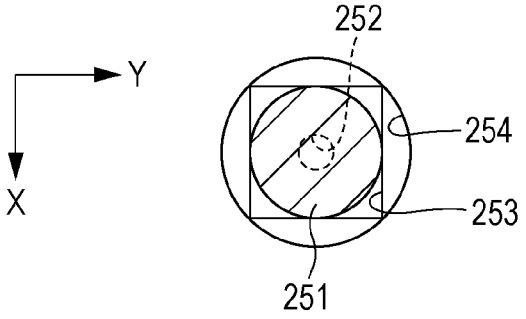
FIG. 11 is a sectional view taken along line XI-XI in FIG. 10.

Herein, a bonding part between the upstream flow path member 210 and the downstream flow path member 220 will be described. FIG. 10 is an enlarged sectional view of a main part illustrating the bonding part between the upstream flow path member and the downstream flow path member. FIG. 11 is sectional view taken along line XI-XI in FIG. 10.

As illustrated in FIGS. 10, 11, and 4, a fixing pin 251 that protrudes to the downstream flow path member 220 side is formed in the upstream flow path member 210 and a fixing hole 253, into which the fixing pin 251 is inserted through penetration in the third direction Z is formed in the downstream flow path member 220. In this embodiment, four fixing pins 251 are disposed in respective corner portions of the upstream flow path member 210 and four fixing holes 253 are disposed at corner portions of the downstream flow path member 220 to correspond to the fixing pins 251.

The fixing pin 251 is formed to have a cylindrical shape, and a screw hole 252 is formed in a tip end portion of the fixing pin 251.

The fixing hole 253 has an inner surface that is in contact with a side surface of the fixing pin 251. In this embodiment, the fixing hole 253 is formed to have a quadrangular opening shape to circumscribe the side surface of the fixing pin 251. In addition, an opening portion 254, which is larger in diameter than the fixing hole 253, is disposed on the side of the fixing hole 253 into which the fixing pin 251 is inserted. The opening portion 254 is formed to be larger in external diameter than the fixing pin 251.

The fixing pin 251 is inserted into the fixing hole 253 and a fixing screw 255 is mounted on the screw hole 252. The upstream flow path member 210 and the downstream flow path member 220 are fixed since the fixing screw 255 is mounted.

Since the opening portion 254 of the fixing hole 253 is formed to be larger than the fixing pin 251 in this manner, the fixing pin 251 can be inserted into the opening portion 254 with ease. This allows rough yet rapid positioning of the upstream flow path member 210 with respect to the downstream flow path member 220 when the upstream flow path member 210 is fixed to the downstream flow path member 220.

The fixing pin 251 can be inserted into the fixing hole 253 when the position of the upstream flow path member 210 is finely adjusted from a state where the fixing pin 251 is inserted into the opening portion 254. The fixing pin 251 circumscribes the fixing hole 253, and thus the movement of the fixing pin 251 in the first direction X and the second direction Y is regulated.

When the upstream flow path member 210 is fixed to the downstream flow path member 220 by the fixing pin 251 and the fixing screw 255, the upstream flow path 500 communicates with the communicating path 232 of the seal member 230 (refer to FIG. 5) and the wall portion 236 of the seal member 230 is arranged inside the leg portion 213*c* (refer to FIGS. 8A to 8C).

The upstream flow path member 210 and the downstream flow path member 220 are fixed as the fixing screw 255 is mounted on the screw hole 252.

The fixing pin 251 may be formed in the downstream flow path member 220 and the fixing hole 253 may be formed in the upstream flow path member 210. In addition, the fixing hole 253 does not necessarily have to have an inner surface that is in contact with an outer surface of the fixing pin 251. In other words, a gap may be present between the inner surface of the fixing hole 253 and the outer surface of the fixing pin 251.

Hereinafter, a method for manufacturing the recording head 1 having the configuration described above will be described. FIGS. 12A to 14B are sectional views illustrating the method for manufacturing the recording head. FIGS. 15A and 15B are sectional views of a main part illustrating the method for manufacturing the recording head.

Figure 12A:
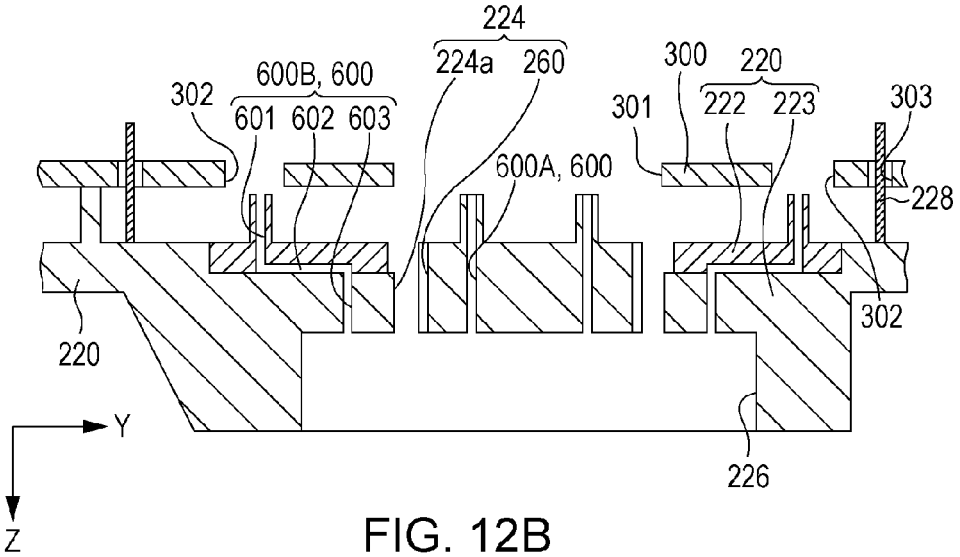
FIGS. 12A and 12B are sectional views illustrating a method for manufacturing the recording head.

As illustrated in FIG. 12A, the wiring substrate 300 is mounted on the downstream flow path member 220. Specifically, the caulking pin 228 is inserted into the caulking hole 303 of the wiring substrate 300.

As described above, the caulking pin 228 and the caulking hole 303 are disposed also to arrange the wiring substrate 300 at a predetermined position with respect to the downstream flow path member 220. In other words, when the wiring substrate 300 is moved for the caulking pin 228 to be inserted into the caulking hole 303, the second protruding portion 221 of the downstream flow path member 220 can arrange the wiring substrate 300 at positions facing the first insertion hole 301 and the through-hole 302 of the wiring substrate 300.

The caulking pin 228 and the caulking hole 303 guide the wiring substrate 300 in this manner so that the wiring substrate 300 is arranged at a predetermined position, and thus the wiring substrate 300 can be easily positioned in and fixed to the downstream flow path member 220.

Figure 12B:
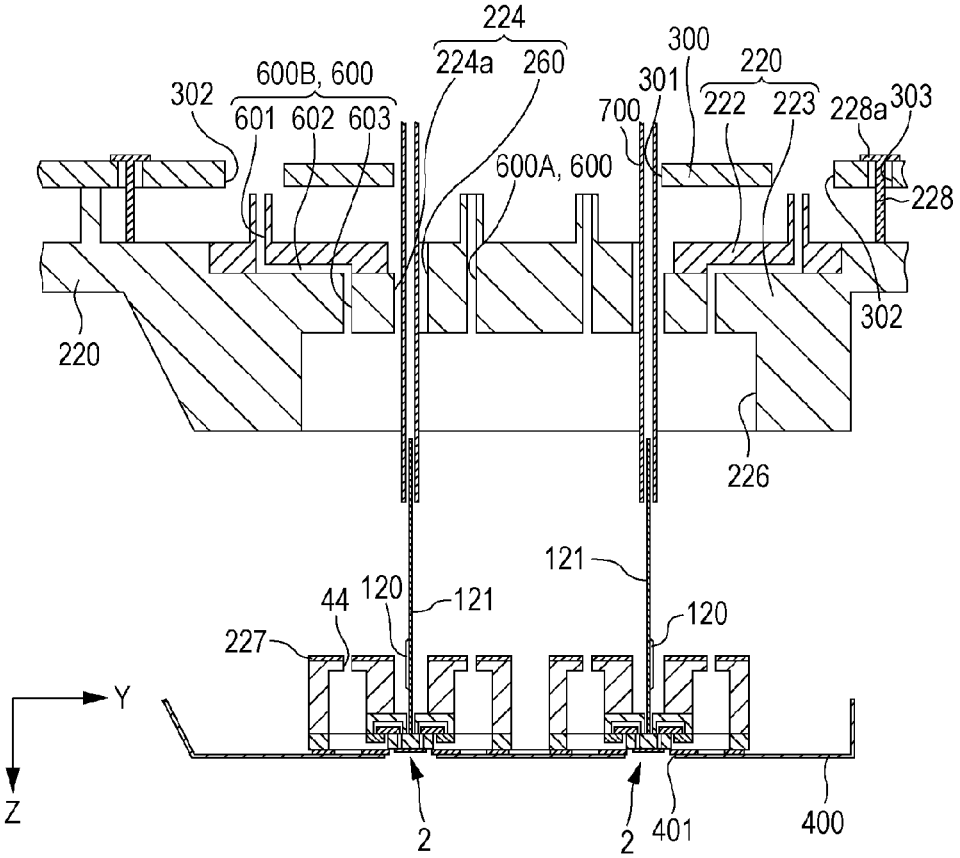

Next, as illustrated in FIG. 12B, the wiring substrate 300 is fixed as the top portion 228*a* of the caulking pin 228 is subjected to thermal caulking. As described above, the seal member 230 and the upstream flow path member 210 are not present yet above the caulking pin 228 in the third direction Z in a state where the wiring substrate 300 is arranged on the downstream flow path member 220 and the caulking pin 228 is inserted into the caulking hole 303. As such, a thermal caulking operation using a tool such as a heat tool can be performed with ease from above the caulking pin 228.

After the wiring substrate 300 is mounted on the downstream flow path member 220 in this manner, a tool 700 that is capable of holding the wiring member 121 is inserted, from the side of the second insertion hole 224 opposite to the accommodating portion 226, into the tool insertion portion 260 of the second insertion hole 224 formed in the downstream flow path member 220 and the first insertion hole 301. Herein, tweezers that pinch the wiring member 121 are used as the tool 700. Then, the wiring member 121 is pinched with the tool 700 while a state where the wiring member 121 is upright in the third direction Z maintained.

In addition, the positions of the downstream flow path member 220 and the cover head 400 in the first direction X and the second direction Y are adjusted so that the first reference mark 229 and the second reference mark 405 described above have a predetermined arrangement. In this manner, the downstream flow path member 220 is arranged at a position where the head chip 2 is accommodated in the accommodating portion 226, the inlet 44 communicates with the downstream flow path 600, and the wiring member 121 is inserted into the second insertion hole 224.

In addition, the adhesive 227 is disposed in advance on the upper surface of the head chip 2 on the inlet 44 side and an adhesive (not illustrated) is also disposed in advance on the surface of the cover head 400 on the downstream flow path member 220 side. In addition, the wiring member 121 is held to be parallel in the third direction Z. The head chip 2 is fixed to the cover head 400 so that the relative positions of the respective nozzles 21 of the respective head chips 2 have a predetermined arrangement.

Figure 13A:
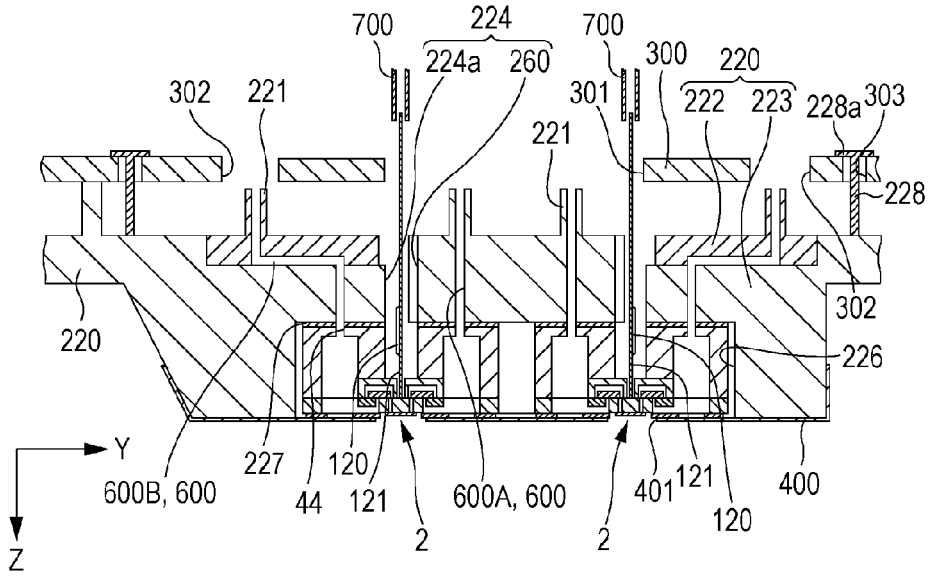
FIGS. 13A and 13B are sectional views illustrating the method for manufacturing the recording head.

Next, as illustrated in FIG. 13A, the tool 700 is relatively moved with respect to the downstream flow path member 220 so that the tool 700 that pinches the wiring member 121 is separated from the downstream flow path member 220 and the wiring substrate 300.

Specifically, the downstream flow path member 220 is moved to the cover head 400 side in the third direction Z while the tool 700 that pinches the wiring member 121 is held. In other words, the tool 700 that holds the wiring member 121 is separated from the downstream flow path member 220, and the tool 700 is withdrawn from the first insertion hole 301 and the second insertion hole 224 with the wiring member 121 pinched. In this manner, the wiring member 121 can be inserted into the first insertion hole 301 and the second insertion hole 224 (wiring member insertion portion 224*a*).

The downstream flow path member 220 is relatively moved with the tool 700 held in the example described above. However, the tool 700 may be relatively moved with the downstream flow path member 220 held. For example, the downstream flow path member 220 and the wiring substrate 300 are held in a state where the tool 700 that pinches the wiring member 121 is inserted into the first insertion hole 301 and the second insertion hole 224. Then, the cover head 400 is moved to the downstream flow path member 220 side. When the cover head 400 is moved in this manner, the tool 700 is pushed up (to the upstream flow path member 210 side) in the third direction Z. In other words, the tool 700 is separated from the downstream flow path member 220 and the wiring substrate 300. Even in this aspect, the tool 700 is withdrawn from the first insertion hole 301 and the second insertion hole 224 with the wiring member 121 pinched. In this manner, the wiring member 121 can be inserted into the first insertion hole 301 and the second insertion hole 224 (wiring member insertion portion 224*a*).

Since the first insertion hole 301 and the tool insertion portion 260, into which the tool 700 can be inserted, are disposed in this manner, an operation for inserting the tool 700 into the first insertion hole 301 and the tool insertion portion 260 in advance can be performed with ease. Then, the wiring member 121 can be inserted into the first insertion hole 301 and the second insertion hole 224 just by pinching the wiring member 121 with the tool 700 that is inserted into the tool insertion portion 260 and moving the downstream flow path member 220 to the cover head 400 side.

In a case where the wiring member 121 having flexibility is directly inserted into the first insertion hole 301 and the second insertion hole 224, an operation for insertion into the first insertion hole 301 and the second insertion hole 224 cannot be facilitated. The operation is particularly difficult in a case where the second insertion hole 224 is formed with a small opening shape for a compact size as in this embodiment.

However, according to this manufacturing method, an operation is performed so that the tool 700 is moved to be separated from the downstream flow path member 220 in a state where the wiring member 121 is pinched with the tool 700 that is inserted in advance into the first insertion hole 301 and the second insertion hole 224. Accordingly, the wiring member 121 can be inserted into the first insertion hole 301 and the second insertion hole 224. In other words, a difficult operation caused when the wiring member 121 is directly inserted into the first insertion hole 301 and the second insertion hole 224 becomes unnecessary. As described above, in this manufacturing method, the wiring member 121 having flexibility can be inserted with ease regardless of the opening shapes of the first insertion hole 301 and the second insertion hole 224.

In addition, both an operation for inserting the tool 700 into the first insertion hole 301 and the second insertion hole 224 (tool insertion portion 260) and an operation for inserting the wiring member 121 into the first insertion hole 301 and the second insertion hole 224 (wiring member insertion portion 224*a*) by moving the tool 700 that pinches the wiring member 121 to separate the tool 700 from the downstream flow path member 220 are operations performed in the third direction Z.

As described above, in this manufacturing method, the wiring member 121 can be inserted into the first insertion hole 301 and the second insertion hole 224 through an operation in the third direction Z, which is vertical to the liquid ejecting surface 20*a*, alone. In other words, an operation for movement in the first direction X or the second direction Y is absent, and thus an operation for inserting the wiring member 121 into the first insertion hole 301 and the second insertion hole 224 can be simplified and accelerated. Accordingly, the efforts and time associated with the manufacturing of the recording head 1 are reduced, and the recording head 1 can be provided at a low cost.

In addition, the shifting of the head chip 2 and the wiring member 121 connected thereto is suppressed since the head chip 2 is fixed to the cover head 400. As such, an operation for inserting the wiring member 121, which is connected to each of the head chips 2, into the first insertion hole 301 and the second insertion hole 224 can be performed with greater reliability.

The downstream flow path member 220 is pressed against and adhered to the cover head 400 after the insertion of the wiring member 121. In this manner, the downstream flow path member 220 and the cover head 400 can be fixed in a state where the head chip 2 is accommodated in the accommodating portion 226, the inlet 44 communicates with the downstream flow path 600, and the wiring member 121 is inserted into the first insertion hole 301 and the second insertion hole 224.

The accommodating portion 226, which is open to the side opposite to the upstream flow path member 210, is disposed in the downstream flow path member 220. Accordingly, an operation for pressing the downstream flow path member 220 against the head chip 2 side and fixing the downstream flow path member 220 to the head chip 2 side from above the cover head 400, to which the head chip 2 is fixed, can be performed with ease.

Herein, in a case where each of the head chips 2 is simply accommodated in and fixed to the accommodating portion 226 of the downstream flow path member 220 without using the cover head 400, it is difficult to align the liquid ejecting surfaces 20*a* on the same plane due to the variations of the thickness of the adhesive 227 disposed on the inlet 44 side of the head chip 2.

However, in the recording head 1 according to this embodiment, the head chip 2 is fixed to the cover head 400 and thus the liquid ejecting surfaces 20*a* of the respective head chips 2 can be arranged, in advance and with high accuracy, on the same plane and each of the head chips 2 can be mounted on the downstream flow path member 220 with the cover head 400 with this state maintained.

In addition, as described above, the first insertion hole 301 is formed to have a wider opening area than in a case where a plurality of the first insertion holes 301 are individually disposed to correspond to each of the two wiring members 121, and thus the wiring member 121 can be easily drawn out of the first insertion hole 301 and assemblability can be improved. Since the wiring member 121 has flexibility, it is difficult to maintain the posture of the member and the alignment is difficult when the opening area is small. However, the wide opening area facilitates the alignment. In addition, an operation for assisting in the maintenance of the posture from the upper surface side can also be facilitated.

Furthermore, the adhesive 227 covers the difference between the depth of the accommodating portion 226 and the height of the head chip 2 even when the depth of the accommodating portion 226 and the height of the head chip 2 do not exactly match each other, and thus the inlet 44 of the head chip 2 can communicate, without a gap, with the downstream flow path 600 that is open to the bottom surface of the accommodating portion 226.

Figure 13B:
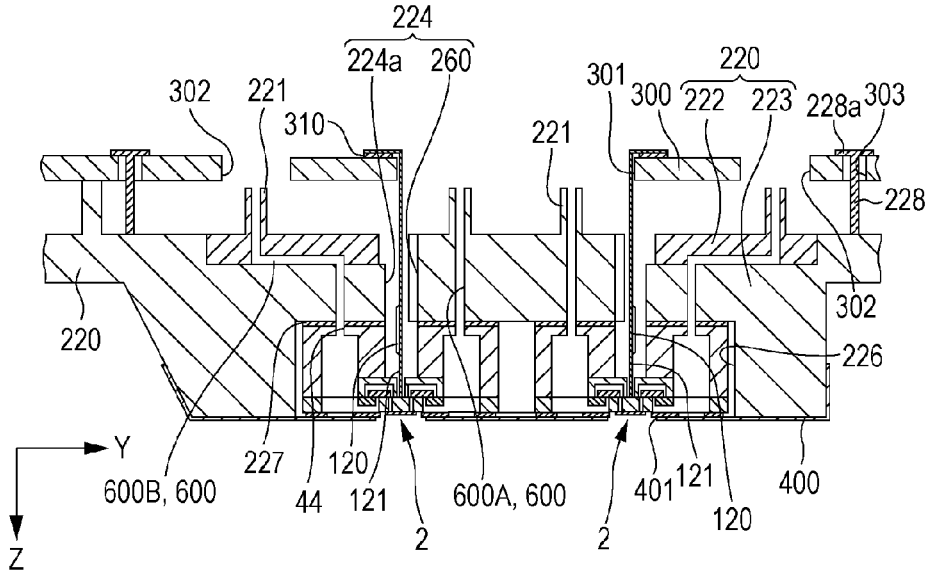

Next, as illustrated in FIG. 13B, the tip end portion of the wiring member 121 is bent and is electrically bonded to the terminal portion 310 of the wiring substrate 300. When the wiring member 121 is electrically bonded to the terminal portion 310, the seal member 230 and the upstream flow path member 210 are not present on the wiring substrate 300 in the third direction Z. As such, an operation for electrically connecting the wiring member 121 to the terminal portion 310 from above the wiring substrate 300 can be performed with ease.

Next, the seal member 230 is mounted on the wiring substrate 300 and the communicating path 232 of the seal member 230 is allowed to communicate with the downstream flow path 600. As described above, the third protruding portion 231 of the seal member 230 is inserted into the through-hole 302 of the wiring substrate 300, and thus the function of guiding the communicating path 232 to the downstream flow path 600 can be achieved.

Figure 14A:
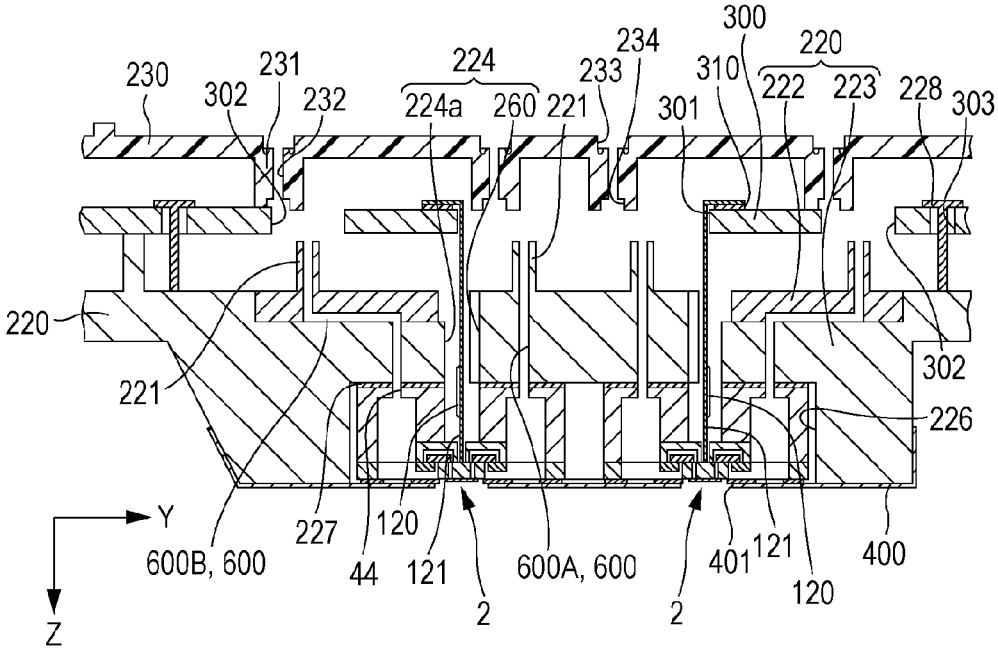
FIGS. 14A and 14B are sectional views illustrating the method for manufacturing the recording head.
Figure 14B:
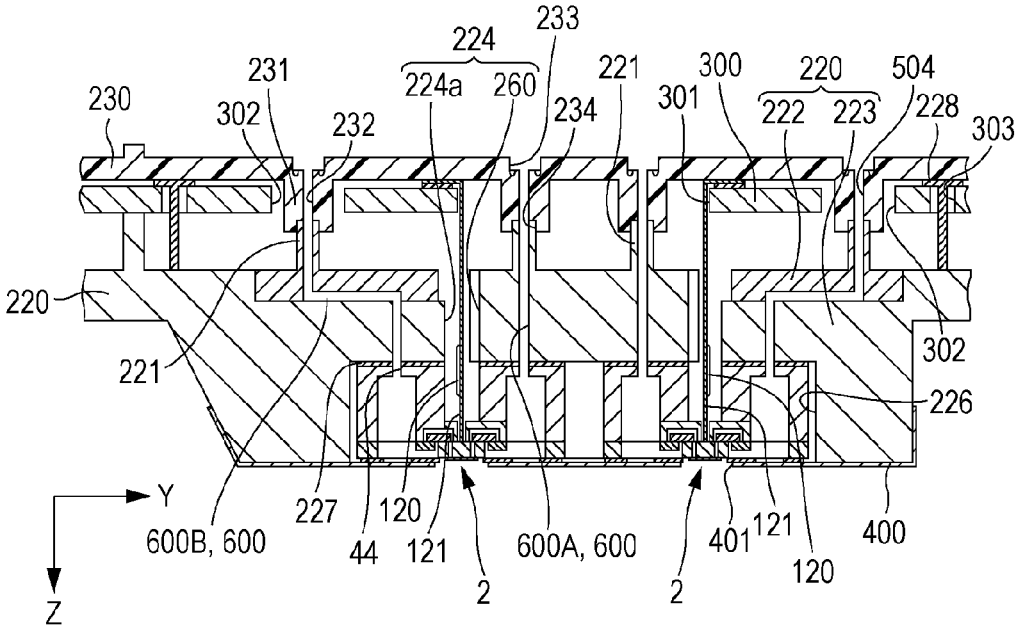
Figure 15A:
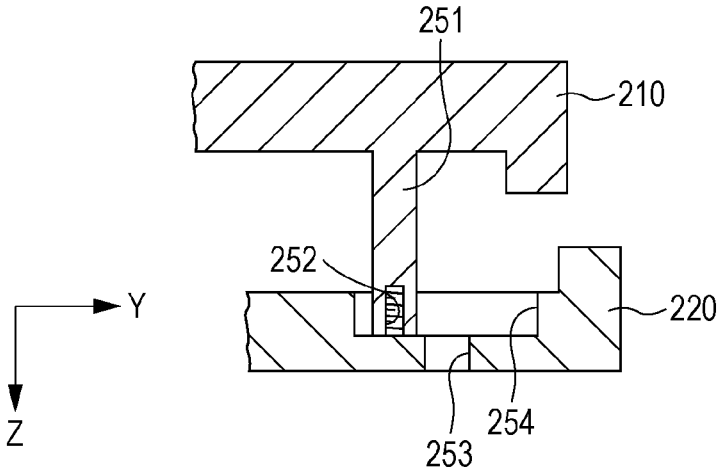
FIGS. 15A and 15B are sectional views of a main part illustrating the method for manufacturing the recording head.
Figure 15B:
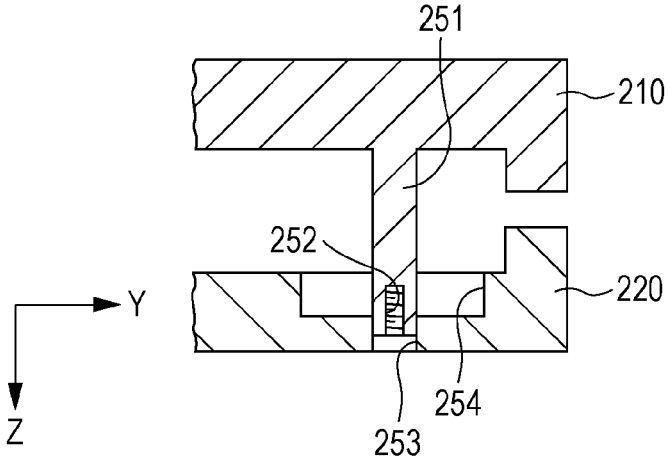

In other words, even when the seal member 230 is arranged at an approximate position on the wiring substrate 300 as illustrated in FIG. 14A, the third protruding portion 231 is inserted into the through-hole 302 as illustrated in FIG. 14B if the seal member 230 is slightly moved in the first direction X and the second direction Y. Then, the communicating path 232 of each of the third protruding portions 231 can be allowed to communicate with the downstream flow path 600 when the third protruding portion 231 is inserted into the through-hole 302. Specifically, the communicating path 232 and the downstream flow path 600 are allowed to communicate with each other by inserting the second protruding portion 221 into the second concave portion 234 that is formed in the third protruding portion 231.

The third protruding portion 231 and the through-hole 302 guide the seal member 230 in this manner to arrange the seal member 230 at a predetermined position. As such, the seal member 230 can be positioned in and fixed to the downstream flow path member 220 with ease.

In addition, the upstream flow path member 210 is not present yet above the seal member 230 in the third direction Z when the seal member 230 is arranged on the wiring substrate 300. Accordingly, an operation for arranging the seal member 230 can be performed with ease.

Next, the upstream flow path member 210 is fixed to the downstream flow path member 220 with the seal member 230 and the wiring substrate 300 pinched therebetween (not illustrated).

Specifically, the fixing pin 251 of the upstream flow path member 210 is inserted into the opening portion 254 of the downstream flow path member 220 as illustrated in FIG. 15A so that an approximate position of the upstream flow path member 210 is determined with respect to the downstream flow path member 220. Then, the position of the upstream flow path member 210 in the first direction X and the second direction Y is finely adjusted as illustrated in FIG. 15B to insert the fixing pin 251 into the fixing hole 253. Then, the fixing pin 251 is fixed with the fixing screw 255 (refer to FIG. 10).

Since the fixing pin 251 is inserted into the opening portion 254 in this manner when the upstream flow path member 210 is fixed to the downstream flow path member 220, a rough yet rapid positioning of the upstream flow path member 210 with respect to the downstream flow path member 220 can be performed. Since the fixing pin 251 is inserted into the fixing hole 253, the upstream flow path member 210 and the downstream flow path member 220 can be fixed in a state where the upstream flow path 500 communicates with the communicating path 232 and the seal member 230 and the wiring substrate 300 are pinched.

In addition, since the accommodating portion 226 is formed in the downstream flow path member 220 as described above, no stress is generated in the head chip 2 even when pressure is applied in the third direction Z. The seal member 230 is just slightly moved in the first direction X and the second direction Y for positioning, and the upstream flow path 500 and the downstream flow path 600 are allowed to communicate as pressure is applied in the third direction Z. In other words, according to this structure, the seal member 230 can be assembled with the upstream flow path member 210 and the downstream flow path member 220 through the movement in the third direction Z or the application of pressure alone in actuality.

Since the accommodating portion 226 is formed in the downstream flow path member 220 in this manner, the application of stress to the head chip 2 can be suppressed and an operation for assembling the seal member 230 can be performed with ease.

As described above, the recording head 1 can be assembled by stacking the respective members in the third direction Z. In other words, no member is moved in the first direction X or the second direction Y. In addition, the respective members are supported by the other members that are positioned below the respective members in the third direction Z after the assembly with the other members, and thus it is unnecessary to maintain the postures and the positions of the members with special equipment.

In this manner, the recording head 1 has a structure particularly suitable for machine-based automatic assembly, and thus the costs associated with the assembly can be reduced significantly.

Other Embodiments

An embodiment of the invention has been described above, but the basic configuration of the invention is not limited to the above description.

The wiring member 121 is inserted into the first insertion hole 301 and the second insertion hole 224 through a single operation in the first embodiment. However, the wiring member 121 may be inserted individually into each of the insertion holes. For example, the wiring member 121 is inserted into the second insertion hole 224 by inserting the tool 700 into the second insertion hole 224 of the downstream flow path member 220, pinching the wiring member 121 with the tool 700, and moving the tool 700 to separate the tool 700 from the downstream flow path member 220. The tool 700 is separated from the wiring member 121 in this manner.

Next, the tool 700 is inserted into the first insertion hole 301 of the wiring substrate 300 and the wiring member 121 is pinched. The wiring substrate 300 is moved to the downstream flow path member 220 side and the tool 700 is moved to be separated from the wiring substrate 300 in a state where the wiring member 121 is pinched with the tool 700. In this manner, the wiring substrate 300 can be mounted on the downstream flow path member 220 and the wiring member 121 can be inserted into the first insertion hole 301.

In addition, the first insertion hole 301 is shaped so that the two wiring members 121 and the tool 700 are inserted, but the invention is not limited to this aspect. A plurality of the first insertion holes, into which the wiring member 121 and the tool 700 can be inserted individually, may be formed not only in the second insertion hole 224 formed in the downstream flow path member 220 but also in the wiring substrate 300 to correspond to the number of the wiring members 121.

In the first embodiment described above, the recording head 1 where the two head chips 2 are disposed has been described. However, the number of the head chips 2 is not particularly limited. The recording head 1 may include one head chip or the recording head 1 may include three or more head chips 2.

In addition, the two wiring members 121 and the third protruding portions 231 corresponding to the two downstream flow paths 600 are inserted into the first insertion hole 301 in the first embodiment described above. However, the invention is not particularly limited thereto. The first insertion hole into which the wiring member 121 is inserted and the through-hole into which the third protruding portion 231 is inserted may be disposed individually. In addition, the through-hole may be disposed independently in each of the third protruding portions 231.

Furthermore, the flow path member 200 that has the upstream flow path member 210 where the upstream flow path 500 is disposed and the downstream flow path member 220 where the downstream flow path 600 is disposed has been described in the first embodiment described above. However, for example, the upstream and the downstream may be reversed in a case where ink (liquid) is circulated. In other words, ink that is supplied to the head chip 2 may be allowed to flow from the downstream flow path 600 to the upstream flow path 500 to be discharged (circulated) to the liquid holding portion, a storage portion where discharged ink is stored, and the like.

In addition, the thin film type piezoelectric actuator 130 has been used in the description of the first embodiment above as the pressure generating unit that causes pressure change in the pressure generating chamber 12, but the invention is not limited thereto. For example, a thick film type piezoelectric actuator that is formed by using a method such as green sheet pasting, a vertical vibration type piezoelectric actuator in which a piezoelectric material and an electrode forming material are stacked alternately to be expanded and contracted in an axial direction, and the like can also be used. In addition, what discharges liquid droplets from a nozzle opening by using bubbles that are generated through heating by heater elements which are arranged in a pressure generating chamber as a pressure generating unit, a so-called electrostatic actuator that discharges liquid droplets from a nozzle opening by deforming a vibrating plate with the electrostatic force of static electricity that is generated between the vibrating plate and an electrode, and the like can also be used.

Figure 16:
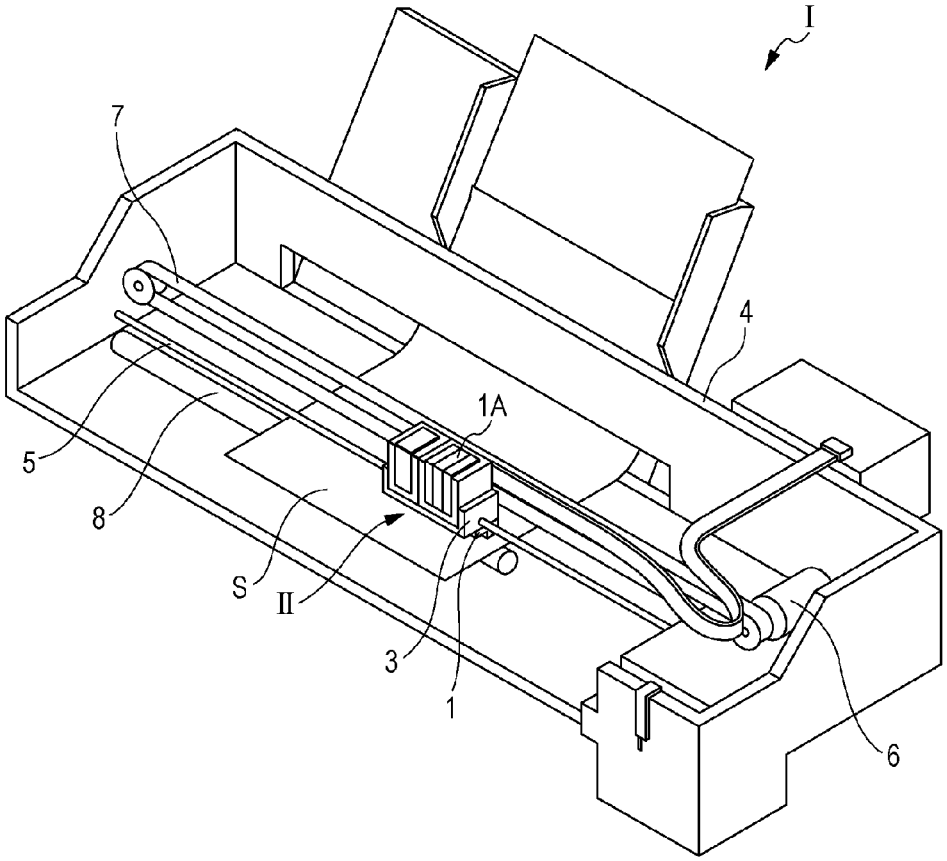
FIG. 16 is a schematic view illustrating an example of an ink jet type recording apparatus.

In addition, the recording head 1 according to the first embodiment constitutes a part of an ink jet type recording head unit that includes an ink flow path which communicates with an ink cartridge and the like, and is mounted on an ink jet type recording apparatus. FIG. 16 is a schematic view illustrating an example of the ink jet type recording apparatus.

In an ink jet type recording head unit II (hereinafter, referred to the head unit II), which has a plurality of the recording heads 1, of an ink jet type recording apparatus I illustrated in FIG. 16, a cartridge 1A that constitutes the liquid holding portion is removably disposed and a carriage 3, on which the head unit II is mounted, is disposed on a carriage shaft 5, which is mounted on an apparatus main body 4, to be movable in the axial direction. The head unit II discharges, for example, a black ink composition and a color ink composition.

When the driving force of a drive motor 6 is transmitted to the carriage 3 via a plurality of gears (not illustrated) and a timing belt 7, the carriage 3 on which the head unit II is mounted is moved along the carriage shaft 5. A platen 8 is disposed along the carriage shaft 5 in the apparatus main body 4. A recording sheet S, which is a recording medium such as paper fed by a feed roller (not illustrated), is wound around the platen 8 and transported.

In addition, the ink jet type recording apparatus I in which the recording head 1 (head unit II) is mounted on the carriage 3 and is moved in a main scanning direction has been described above, but the invention is not limited thereto. For example, the invention can also be applied to a so-called line type recording apparatus that performs printing by moving the recording sheet S such as paper only in a sub-scanning direction with the recording head 1 fixed thereto.

In addition, the cartridge 1A, which is a liquid holding portion, is configured to be mounted on the carriage 3 in the ink jet type recording apparatus I according to the example described above, but the invention is not limited thereto. For example, the liquid holding portion such as an ink tank may be fixed to the apparatus main body 4 and the liquid holding portion and the recording head 1 may be connected via a supply tube such as a tube. In addition, the liquid holding portion may not be mounted on the ink jet type recording apparatus.

Furthermore, the invention targets a wide range of liquid ejecting heads in general. For example, the invention can also be applied to recording heads such as various types of ink jet type recording heads used in image recording apparatuses such as printers, color material ejecting heads used in manufacturing color filters such as liquid crystal displays, electrode material ejecting heads used in forming electrodes such as organic EL displays and field emission displays (FED), bio-organic material ejecting heads used in manufacturing biochips, and the like.

What is claimed is:

1. A method for manufacturing a liquid ejecting head including a head chip that ejects a liquid from a liquid ejecting surface, a first flow path member where a first flow path for the liquid is disposed, a second flow path member is bonded to the first flow path member, where the second flow path member includes an accommodating portion that is open to the side opposite to the first flow path member and accommodates the head chip, and a second flow path for the liquid is open into the accommodating portion and is connected to the first flow path, a wiring member is connected to a pressure generating unit which generates pressure change in a flow path in the head chip, and a wiring substrate is arranged between the first flow path member and the second flow path member, wherein the wiring member is inserted into a first insertion hole that is open to the first flow path member and the second flow path member side, the first insertion hole is formed in the wiring substrate, and the wiring member is inserted into a second insertion hole that is open to the accommodating portion and the wiring substrate side, the second insertion hole is formed in the second flow path member, and the wiring member is bonded to the wiring substrate, and wherein the second insertion hole is formed so that a tool which holds the wiring member can be inserted, the method comprising:

inserting the tool from the opening of the second insertion hole on the first flow path member side;

holding the wiring member that is connected to the pressure generating unit of the head chip with the tool; and inserting the wiring member into the second insertion hole by relatively moving the tool with respect to the second flow path member so that the tool which holds the wiring member is separated from the second flow path member.

2. The method for manufacturing a liquid ejecting head according to claim 1, wherein the first insertion hole of the wiring substrate is formed so that the tool which holds the wiring member can be inserted, wherein the tool is inserted from the openings of the first insertion hole and the second insertion hole on the first flow path member side, wherein the wiring member that is connected to the pressure generating unit of the head chip is held with the tool, and wherein the wiring member is inserted into the first insertion hole and the second insertion hole by relatively moving the tool with respect to the wiring substrate and the second flow path member so that the tool which holds the wiring member is separated from the wiring substrate and the second flow path member.

3. The method for manufacturing a liquid ejecting head according to claim 1, wherein the head chip is fixed to a fixing member that is fixed to the second flow path member, and wherein the wiring member that is connected to the head chip which is fixed to the fixing member is held by using the tool.

4. The method for manufacturing a liquid ejecting head according to claim 1, wherein a wiring member insertion portion into which the wiring member is inserted and a tool insertion portion into which the tool is inserted are integrally formed in at least one of the first insertion hole and the second insertion hole, wherein the tool is inserted into the tool insertion portion, and wherein the wiring member is inserted into the wiring member insertion portion by relatively moving the tool with respect to the second flow path member so that the tool which holds the wiring member is separated from the second flow path member.

* * * * *